US006862849B2

(12) United States Patent
Kim

(10) Patent No.: US 6,862,849 B2
(45) Date of Patent: Mar. 8, 2005

(54) DIRECTIONAL SLIDING PENDULUM SEISMIC ISOLATION SYSTEMS AND ARTICULATED SLIDING ASSEMBLIES THEREFOR

(76) Inventor: Jae Kwan Kim, Daelim Apartment 6-109, Jamwon-dong, Seocho-ku, Seoul, 137-947 (KR)

( * ) Notice: Subject to any disclaimer, the term of this patent is extended or adjusted under 35 U.S.C. 154(b) by 0 days.

(21) Appl. No.: 10/639,200

(22) Filed: Aug. 12, 2003

(65) Prior Publication Data

US 2004/0045236 A1 Mar. 11, 2004

Related U.S. Application Data

(62) Division of application No. 09/894,506, filed on Jun. 28, 2001, now Pat. No. 6,631,593.

(30) Foreign Application Priority Data

Jul. 3, 2000 (KR) ..... 2000-37760
Nov. 10, 2000 (KR) ..... 2000-66820

(51) Int. Cl.[7] ..... E04B 1/98
(52) U.S. Cl. ..... 52/167.9; 52/167.1; 248/562; 248/636
(58) Field of Search ..... 52/167.1, 167.4, 52/167.9; 248/562, 636

(56) References Cited

U.S. PATENT DOCUMENTS 4,320,549 A * 3/1982 Greb ..... 14/73.5
4,596,373 A * 6/1986 Omi et al. ..... 248/562
4,644,714 A * 2/1987 Zayas ..... 52/167.4
5,867,951 A * 2/1999 Yaguchi et al. ..... 52/167.4
5,934,029 A * 8/1999 Kawai et al. ..... 52/167.5
5,970,666 A * 10/1999 Kurabayashi et al. ..... 52/167.6
6,085,473 A * 7/2000 Teramachi et al. ..... 52/167.5
6,092,780 A * 7/2000 Kurabayashi et al. ..... 248/636
6,126,136 A * 10/2000 Yen et al. ..... 248/560
6,164,022 A * 12/2000 Ishikawa et al. ..... 52/167.5
6,385,917 B1 * 5/2002 Konomoto ..... 52/167.6
6,725,612 B2 * 4/2004 Kim ..... 52/167.5
6,820,380 B2 * 11/2004 Tsai ..... 52/167.4

* cited by examiner

*Primary Examiner*—Brian E. Glessner
(74) *Attorney, Agent, or Firm*—Head, Johnson & Kachigian

(57) ABSTRACT

A bi-directional sliding pendulum seismic isolation system for reducing seismic force acting on a structure by sliding pendulum movements, each system comprising a lower sliding plate forming a sliding path in a first direction, an upper sliding plate forming a sliding path in a second direction, and a sliding assembly for reducing the seismic force of the structure by performing a pendulum motion by sliding along the lower and upper sliding plates.

2 Claims, 46 Drawing Sheets

DIRECTIONAL SLIDING PENDULUM SEISMIC ISOLATION SYSTEMS AND ARTICULATED SLIDING ASSEMBLIES THEREFOR

This is a divisional application of Ser. No. 09/894,506 filed Jun. 28, 2001 now U.S. Pat. No. 6,631,593.

FIELD OF THE INVENTION

1. Field of the Invention

The present invention relates to directional sliding pendulum seismic isolation systems and articulated sliding assembly therefor, and more particularly, to directional sliding pendulum seismic isolation systems and articulated sliding assemblies therefore, that can reduce seismic load applied to structures, such as bridges or general buildings, through directional pendulum motion and frictional sliding.

2. Description of the Related Art

Recently, multi-span continuous bridges are widely used. In general, such a multi-span continuous bridge is designed to have a single fixed point in the longitudinal direction of the bridge. FIG. 1*a* shows an example of the conventional multi-span continuous bridge. In the conventional 4-span continuous bridge, a fixed support 102 is installed on a fixed support pier 103, which is located in the middle of the 4-span continuous bridge, to restrict the longitudinal movement of the superstructure 101 of the bridge. Movable supports 107 are installed on movable support piers 104, 105 and 106 to permit free longitudinal movement of the superstructure 101 of the bridge. FIG. 1*b* is a schematic view illustrating the deformation of the 4-span continuous bridge of FIG. 1*a* when a seismic load is imparted thereto. Referring to FIG. 1*b*, the seismic load is applied to the superstructure 101 of the bridge in the arrow direction "b" by an earthquake ground motion expressed in the arrow direction "Ug". The superstructure 101 of the bridge moves in the longitudinal direction of the bridge due to the seismic load. If the frictional force is negligible at the movable supports, the seismic load imparted to the superstructure 101 of the bridge would be transmitted solely to the fixed support pier 102 through the fixed support 103. The fixed support pier 102 provided with the fixed support 103 would withstand the whole seismic load transmitted from the superstructure 101 of the bridge, and finally be forced to deform as shown FIG. 1*b*. If an excessive seismic load is applied to the fixed support pier 102, the bridge itself as well as the fixed support 103 of the fixed support pier 102 will be seriously damaged, consequently resulting in possible failure of the fixed support pier 102.

In traditional earthquake resistant design of bridges and general structures, the structural members, components and systems are required to have adequate amount strength and ductility in the event of strong earthquakes. However, the structures designed according to this strength design principle tend to experience severe damage or excessive deformation in the event of very strong earthquake even though they may not collapse. Therefore alternative methods have been developed that can protect structures from earthquakes within predetermined deformation limit. One of the most widely used protection methods is seismic isolation system. Because it has been proved to be very effective in the reduction of seismic load in recent earthquakes, the use of seismic isolation systems is on an increasing trend.

The basic principle of the seismic isolation system will be explained in connection with the earthquake actions. However, the seismic isolation systems according to the present invention are not restricted to the earthquake motion, and can be applied also to various kinds of dynamic loads applied to the structures.

If a structure 201 is fixed to the ground 202 as shown in FIG. 2*a*, it can be modeled as a single degree of freedom system as shown in FIG. 2*b*. The response of the structure to the earthquake action, such as base shear force and relative displacement can be estimated using response spectra.

FIGS. 2*c* and 2*d* show graphs of acceleration response spectra and graphs of displacement response spectra respectively as examples. The drawings show response spectra for two values of damping ratio. In the graph of FIG. 2*c*, the vertical axis indicates the spectral acceleration and the horizontal axis indicates the period. In the graph of FIG. 2*d*, the vertical axis indicates the spectral displacement and the horizontal axis indicates the period. The base shear force acting between the structure and the ground by the horizontal ground motion can be estimated from the acceleration response spectrum shown in FIG. 2*c*. That is, if the natural period and the damping ratio ($\xi_1$ or $\xi_2$) of the single degree of freedom are given, the spectral acceleration is read from the curves shown in FIG. 2*c*. If the obtained spectral acceleration value is multiplied by the mass of the structure, the base shear force is approximately found.

The relative displacement between the superstructure and the ground can be estimated from the displacement response spectrum shown in FIG. 2*d*. If the natural period of the single degree of freedom and the damping ratio are given, the spectral displacement is read from the curves shown in FIG. 2*d*. The obtained spectral displacement shows the relative displacement of the ground of the single degree of freedom.

As can be seen from the graph shown in FIG. 2*c*, generally, if the period becomes longer, the spectral acceleration is reduced. Moreover, in the same period, if the damping ratio becomes larger, the value of the spectral acceleration is reduced.

In the case of the spectral displacement, as can be seen from the graph shown in FIG. 2*d*, if the period becomes longer, the relative displacement is increased. Furthermore, in the same period, if the damping ratio becomes larger, the value of the spectral displacement is reduced.

In conclusion, if the period is longer and the damping ratio is higher, the spectral acceleration is reduced, and thereby the seismic force, i.e., floor shear force, becomes small. The seismic isolation systems adopt the above mechanical principle. For example, the seismic isolation system such as a high damping lead rubber bearing has mechanical properties that the horizontal stiffness is very small but the damping capacity is high.

As shown in FIG. 3*a*, if a seismic isolation system 203 is installed between the base frame and a ground 202, the natural period of the whole structural system becomes even longer, and also the damping ratio increases. Like this, if the natural period T becomes longer period $T_e$ or the damping ratio $\xi$ is increased to a ration $\xi_e$, then the seismic force can be reduced significantly, as can be seen from the graph shown in FIG. 3*b*.

However, as shown in FIG. 3*c*, if the natural period becomes longer, the relative displacement increases. To restrict the increase of the relative displacement, dampers can be installed in addition to the conventional seismic isolation system having low damping capacity. One of the seismic isolation systems having high damping capacity and the long natural period, which do not require the additional dampers, is a sliding pendulum seismic isolation system. However, the sliding pendulum seismic isolation system used presently has a structure that a slider moves on a dish having a concave surface, and therefore if the seismic isolating period becomes longer, the diameter of the dish becomes even larger. In the case of bridges, generally, an area to install a seismic isolator on a pier or an abutment is extremely restricted. Therefore, a long span bridge requiring the seismic isolating period of a long-term has a difficulty in using the conventional sliding pendulum seismic isolation system of the dish type.

SUMMARY OF THE INVENTION

It is, therefore, an object of the present invention to provide a sliding pendulum seismic isolation system having a new configuration, which can be easily installed without limitations in an installation area.

It is another object of the present invention to provide a sliding pendulum seismic isolation system, which does not use dampers additionally employed in a conventional seismic isolation system that has low damping capacity.

It is a further object of the present invention to provide a sliding pendulum seismic isolation system, which moves in predetermined directions and yet effectively induces seismic isolation effects in all horizontal directions for the earthquake motion that is applied in arbitrary direction.

It is a still further object of the present invention to provide a sliding assembly, which has newly structured sliders, used in a directional sliding pendulum seismic isolation system. Even though the sliding assembly is located at any position, the surfaces of upper and lower sliders in contact with a friction channel of the sliding pendulum seismic isolation system are kept uniform, and thus the compressive force is always transferred to the friction channel through the center of the sliders.

To achieve the above objects, the present invention provides a directional sliding pendulum seismic isolation system, which reduces earthquake effects on the structures using sliding pendulum motion in selected directions.

The present invention provides bi-directional sliding pendulum seismic isolation systems for reducing seismic force acting on a structure by sliding pendulum movements, each system comprising a lower sliding plate forming a sliding path in a first direction; an upper sliding plate forming a sliding path in a second direction; and a sliding assembly for reducing the seismic force of the structure by performing a pendulum motion by sliding along the lower and upper sliding plates.

In the present invention, the lower and the upper sliding plates have sliding channels for sliding of the sliding assembly respectively, and the sliding assembly includes a main body, lower sliders sliding along the lower sliding channel, and upper sliders sliding along the upper sliding channel.

According to the embodiment of the present invention, the lower and the upper sliding plates have sliding channels for sliding of the sliding assembly, and the sliding assembly includes an upper main body on which an upper slider is mounted on an upper surface thereof, a lower main body on which a lower slider is mounted on a lower surface thereof, and elastic or elasto-plastic objects inserted between the lower and upper main bodies. In one application, the upper main body and lower main body of the sliding assembly can rotate freely around vertical axis Further, in another embodiment of the present invention, the lower and the upper sliding plates have at least a pair of sliding channels for sliding of the sliding assembly, wherein the sliding assembly has a ratio of a predetermined width/height not to be overturned when the sliding assembly performs the pendulum motion, and wherein radius of curvature of an arc section of the upper sliding channel has a value smaller than radius of curvature of the first directional pendulum motion to prevent the upper slider from escaping from the upper sliding channel while the sliding assembly performs the pendulum motion in the lower sliding channel, and radius of curvature of an arc section of the lower sliding channel has a value smaller than radius of curvature of the second directional pendulum motion to prevent the lower slider from escaping from the lower sliding channel while the sliding assembly performs the pendulum motion in the upper sliding channel.

In the above embodiment, preferably, the elastic or elasto-plastic objects of the upper and lower separable sliding assembly are spheres having a predetermined elasticity and damping capacity, and the lower and the upper main bodies have hemispherical holes for mounting the spherical elastic or elasto-plastic objects respectively.

Further, in the above embodiment, preferably, the elastic or elasto-plastic objects of the upper and lower separable sliding assembly are spheres having a predetermined elasticity and damping capacity, and the lower and the upper main bodies have a hemispherical central hole for mounting the spherical elastic or elasto-plastic objects and a contour hole around the central hole respectively.

Further, in another embodiment, the lower and the upper main bodies have a hemispherical central hole and a contour hole around the central hole respectively, the spherical elastic or elasto-plastic object having a predetermined elasticity and damping capacity is mounted in the central hole, and annular elastic or elasto-plastic objects having a predetermined elasticity and damping capacity are mounted in the contour hole.

In another embodiment, the elastic or elasto-plastic object of the upper and lower separable sliding assembly is a disc type having a predetermined elasticity and damping capacity, and the lower and the upper main bodies have a hole for mounting the disc type elastic or elasto-plastic object respectively.

In the present invention, the sliding channels may be formed in multiple, and an escape preventing sill may be provided between the sliding channels to prevent the sliders of the sliding assembly from escaping from the sliding channels.

Further, the present invention provides unidirectional sliding pendulum seismic isolation systems for reducing seismic force of a structure by earthquake motion of one direction, each system comprising a sliding plate having a sliding channel forming a sliding path in one direction; and a sliding assembly for reducing the seismic force of the structure by performing pendulum motion by sliding along the sliding channel.

The present uni-directional sliding pendulum seismic isolation systems may be installed in multi-level to induce seismic isolation effects in all horizontal directions by performing pendulum motion in two directions horizontally.

Further, the present invention provides a sliding assembly used in a bi-directional sliding pendulum seismic isolation system, the sliding assembly comprising: a main body; a lower slider provided at a lower portion of the main body, the lower slider sliding along a lower sliding channel of a lower sliding plate of the bi-directional sliding pendulum seismic isolation system; and an upper slider provided at an upper portion of the main body, the upper slider sliding along an upper sliding channel of an upper sliding plate of the bi-directional sliding pendulum seismic isolation system.

In the embodiment of the sliding assembly, the lower and upper sliders includes a slider support; and a slider core mounted at an end of the slider support to freely rotate with respect to the slider support, the slider core being in frictional contact with the sliding channels in such a manner that the area contacting the sliding channels remains unchanged even though the sliding assembly is located in an arbitrary position in the sliding channels.

Further, in the embodiment of the sliding assembly, the slider core has an upper surface of a shape corresponding to radius of curvature of the sliding channels and a lower surface of a semicircular plate type having a predetermined thickness and radius of curvature, and rotates with respect to the slider support when the lower surface is mounted in the slider support.

In another embodiment of the sliding assembly, the slider core has an upper surface of a shape corresponding to radius of curvature of the sliding channels and a lower surface of a round shape having a predetermined radius of curvature, and rotates with respect to the slider support when the slider core is inserted in the slider support.

In another embodiment of the sliding assembly, the slider includes a slider support having a disc type supporting part of a predetermined thickness and radius of curvature of a convex form at an end; and a slider core having an upper surface of a shape corresponding to the radius of curvature of the sliding channels and a concave part corresponding to the disc type supporting part, the slider core being mounted on the slider support in such a manner that the disc type supporting part is inserted into the concave part. The slider core can rotate freely with respect to the slider support.

In another embodiment of the sliding assembly, the slider includes a slider support having a spherical supporting part of a predetermined radius of curvature, which is in the form of a convex at an end; and a slider core having an upper surface of a shape corresponding to the radius of curvature of the sliding channels and a concave part corresponding to the spherical supporting part, the slider core being mounted on the slider support in such a manner that the spherical supporting part is inserted into the concave part, the slider core freely rotating with respect to the slider support.

Preferably, in the sliding assembly, friction-reducing materials are coated on the surface of the slider core to reduce a friction between the slider core and the sliding channel and a friction between the slider core and the slider support.

The present invention also provides a sliding assembly used in a unidirectional sliding pendulum seismic isolation system, the sliding assembly comprising a main body; and a slider formed at an upper portion of the main body, the slider sliding along the sliding channel of the sliding plate of the uni-directional sliding pendulum seismic isolation system, wherein the slider includes a perpendicular slider support and a slider core mounted at an end of the slider support and being in frictional contact with the sliding channel, and wherein the slider core is mounted to rotate with respect to the slider support and maintains contact area with the sliding channels even though the sliding assembly is located in an arbitrary position in the sliding channels.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

The present invention will now be described in detail in connection with preferred embodiments with reference to the accompanying drawings.

Figure 4:
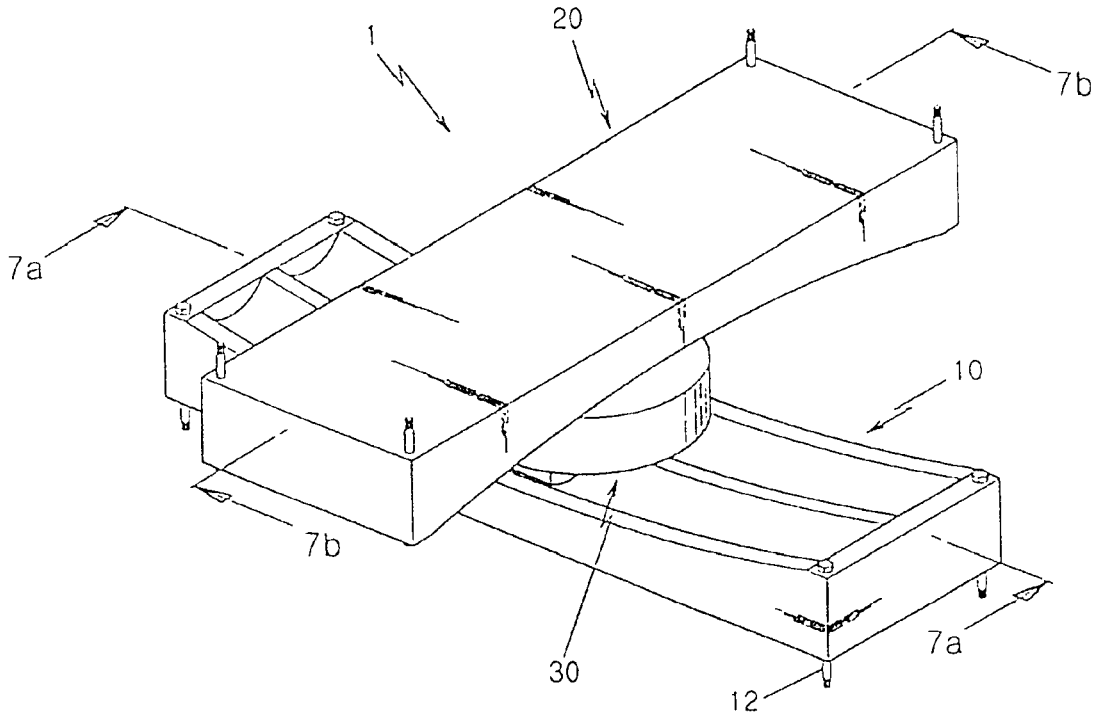
FIG. 4 is a schematically perspective view of a bi-directional sliding pendulum seismic isolation system according to the present invention.

FIG. 4 shows a schematically perspective view of an embodiment of bi-directional sliding pendulum seismic isolation systems according to the present invention.

As shown in FIG. 4, the bi-directional sliding pendulum seismic isolation system 1 according to the present invention includes a lower sliding plate 10 forming a sliding path in the first direction, an upper sliding plate 20 forming a sliding path in the second direction, and a sliding assembly 30 sliding in the two directions and performing the pendulum motion between the lower sliding plate 10 and the upper sliding plate 20.

Figure 5A:
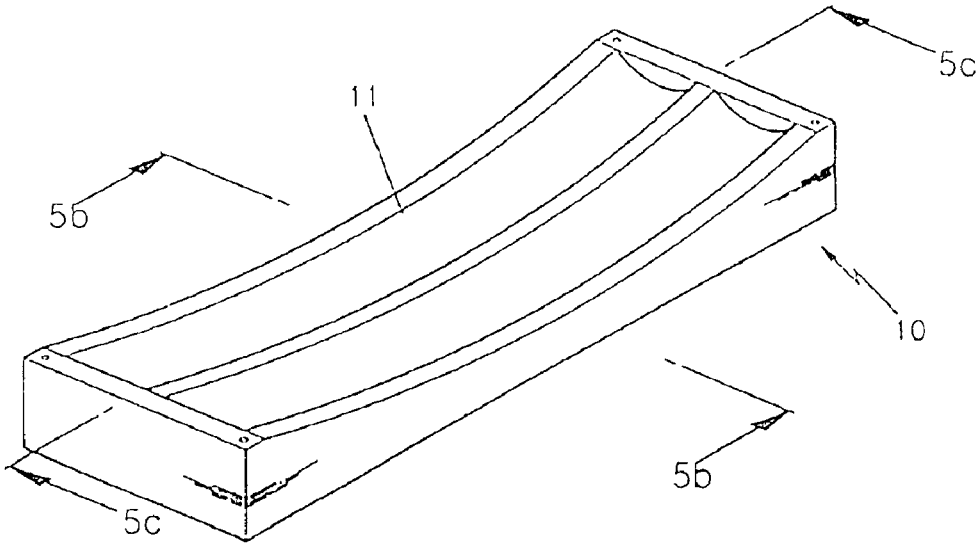
FIGS. 5*a* through 5*c* are schematically perspective views of a sliding plate of the bi-directional sliding pendulum seismic isolation system according to the present invention.
Figure 5B:
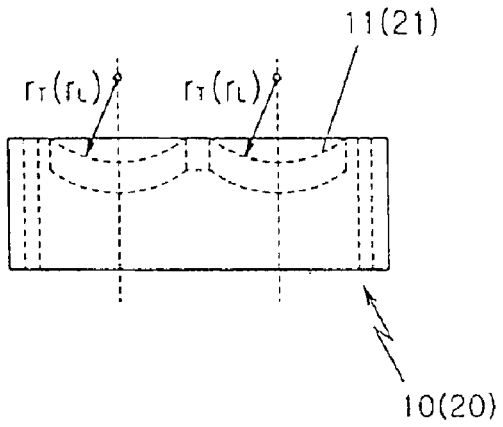
Figure 5C:
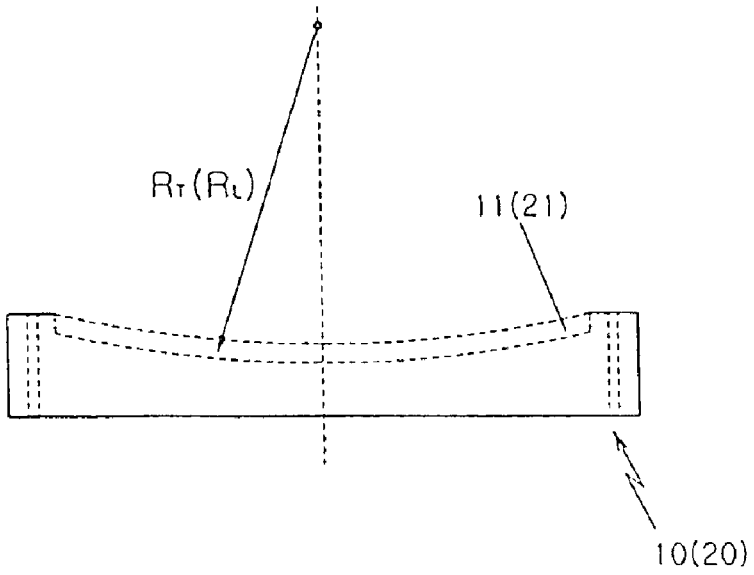

FIGS. 5*a* through 5*c* show the lower sliding plate 10 in more detail. FIG. 5*a* is a perspective view of the lower sliding plate 10, and FIGS. 5*b* and 5*c* are views taken along the lines C—C and D—D in FIG. 5*a*. As shown in FIG. 5*a*, the lower sliding plate 10 has lower sliding channels 11 for allowing the sliding assembly 30 to slide. As shown in FIG. 5*b*, the lower sliding channel 11 is in the form of a concave arc section of a predetermined radius of curvature ($r_T$) and is in the form of an arc of a predetermined radius of curvature ($R_T$) in a longitudinal direction, i.e., the first direction. The radius of curvature ($r_T$) of the arc section has a value even smaller than the radius of curvature ($R_T$) of the pendulum motion. In FIG. 4, the reference numeral 12 indicates coupling means 12, such as a bolt, for fixing the lower sliding plate 10 to the structure.

In the embodiment, the lower sliding channel 11 is formed as a pair of parallel channels, but may be two or more channels without being restricted in the number of the channels. However, at least a pair of parallel channels should be formed to prevent the sliding assembly 30 from being overturned to a horizontal motion of an arbitrary direction.

In the bi-directional sliding pendulum seismic isolation system 1 of the present invention, in the same way as the lower sliding plate 10, the upper sliding plate 20 is also in the form of a concave arc section of a predetermined radius of curvature ($r_L$) and is in the form of an arc of a predetermined radius of curvature ($R_L$) in a longitudinal direction (the second direction). The upper sliding plate 20 has a pair of parallel upper sliding channels 21, on which the sliding assembly 30 slides. In the same way as the lower sliding plate 10, the upper sliding plate 20 may also have two or more sliding channels, and must have at least a pair of parallel channels to prevent the sliding assembly 30 from being overturned.

Figure 6A:
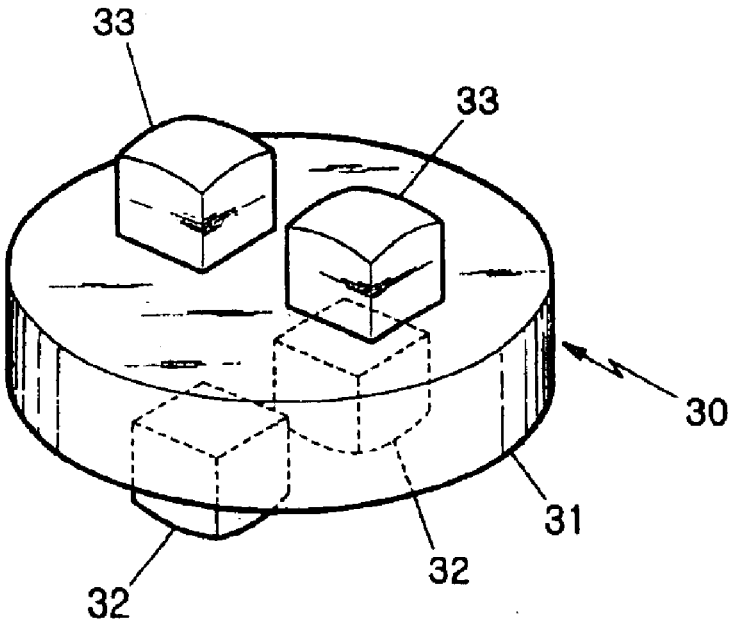
FIGS. 6*a* through 6*c* are a schematically perspective view and sectional views of a sliding assembly of the bi-directional sliding pendulum seismic isolation system according to the present invention.
Figure 6B:
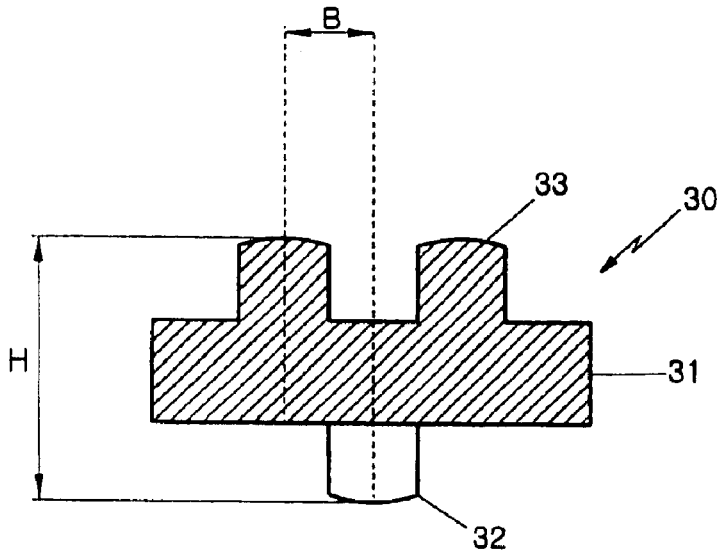

The sliding assembly 30, which slides along the sliding channels 11 and 21, is mounted between the lower sliding plate 10 and the upper sliding plate 20. FIGS. 6*a* and 6*b* show schematically perspective and sectional views of an embodiment of the sliding assembly 30. The sliding assembly 30 includes a plate type main body 31, a lower slider 32 provided at a lower portion of the main body 31 and sliding along the sliding channel 11 of the lower sliding plate 10, and an upper slider 33 provided at an upper portion of the main body 31 and sliding along the sliding channel 21 of the upper sliding plate 20.

Figure 6C:
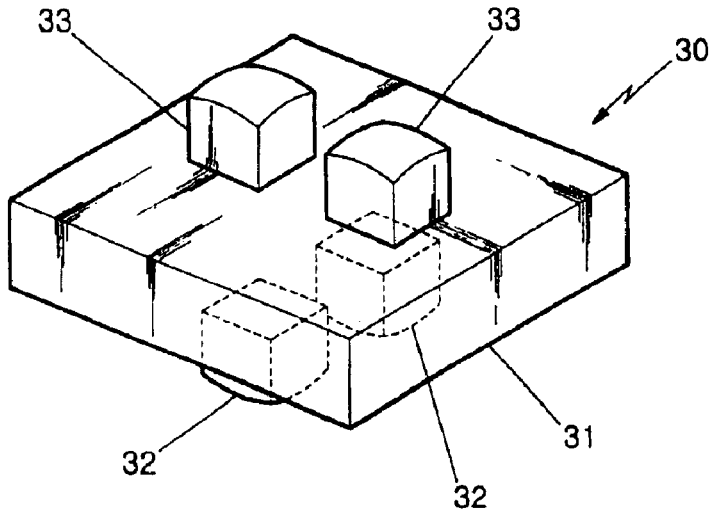

The plate type main body 31 is not restricted to a disc form, but may be in various forms, such as a polygon including a rectangle, an oval, or the likes, as shown in FIG. 6*c*. Furthermore, the lower slider 32 and the upper slider 33 may be formed in a plural number corresponding to the number of the lower and upper sliding channels 11 and 21. Modifications of another sliding assembly 30 will be described later.

A coupled relationship between the upper and lower sliding plates 10 and 20 and the sliding assembly 30 will be described hereinafter.

Figure 7A:
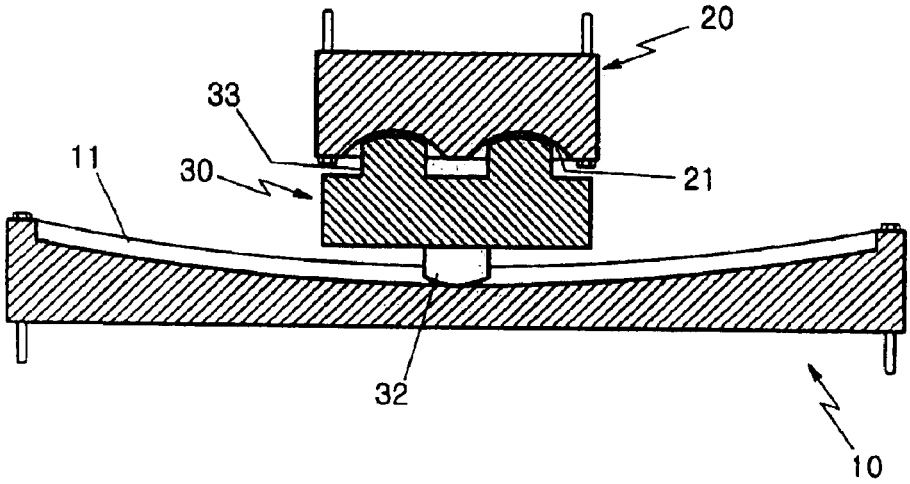
FIGS. 7*a* and 7*b* are sectional views showing a coupling relationship between upper and lower sliding plates and the sliding assembly.
Figure 7B:
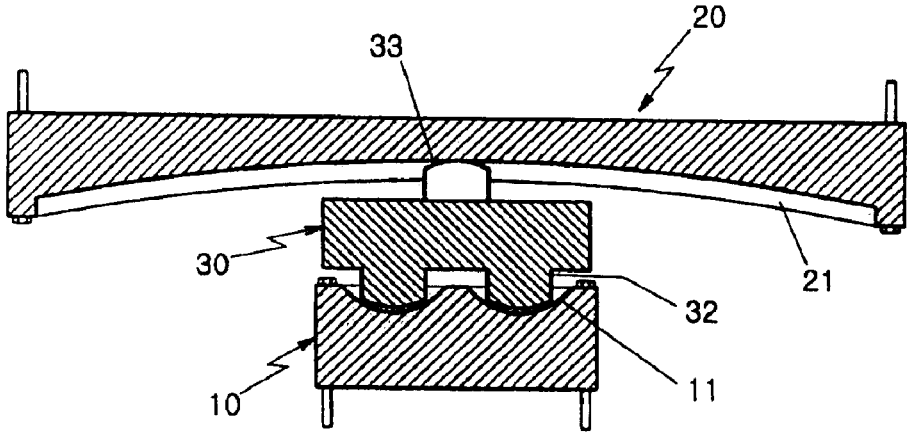

FIG. 7*a* is a sectional view taken along the line A—A of FIG. 4 and FIG. 7*b* is a sectional view taken along the line B—B of FIG. 4. The lower slider 32 of the sliding assembly 30 is positioned at into the lower sliding channel 11 of the lower sliding plate 10 and the upper slider 33 is positioned at the upper sliding channel 21 of the upper sliding plate 20, thereby being mounted perpendicularly. If a distance (B) from the center of the sliding assembly 30 to the center of the slider 32 or 33 and a ratio (B/H) of a height (H) of the sliding assembly 30 defined in FIG. 6*b* are larger than the friction coefficient between the slider and the sliding channel, a stability to the overturning can be maintained when the sliding assembly 30 slides along the sliding channel and performs the pendulum motion. The radius of curvature ($r_L$) of the arc section of the upper sliding channel 21 formed on the upper sliding plate 20 has a value even smaller than that of the radius of curvature ($R_T$) of the first directional pendulum motion, the upper slider 33 does not escape from the upper sliding channel 21 while the sliding assembly 30 performs the pendulum motion in the lower sliding channel 11 formed in the lower sliding plate 10. If the radius of curvature ($r_T$) of the arc section of the lower sliding channel 11 formed on the lower sliding plate 10 has a value much smaller than that of the radius of curvature ($R_L$) of the second directional pendulum motion, the lower slider 32 does not escape from the lower sliding channel 11 while the sliding assembly 30 performs the pendulum motion in the upper sliding channel 21 formed in the upper sliding plate 20.

Referring to FIGS. 8*a* through 8*d* showing an example that the bi-directional sliding pendulum seismic isolation system 1 of the present invention is installed on a bridge, the operation of the present invention will be described. The upper sliding plate 20 is fixed on the deck 101 of the bridge in such a manner that the upper sliding channel 21 is in a longitudinal direction of bridge, i.e., the second direction becomes the longitudinal direction. The lower sliding plate 10 is fixed on a pier 110 and an abutment 120 of the bridge in such a manner that the lower sliding channel 11 is at right angles to the longitudinal direction of bridge, namely, the first direction is at right angles to the longitudinal direction of bridge. An example that the earthquake motion is applied will be described hereinafter.

In the seismic isolation system of the present invention, because the radius of curvature ($R_L$) of the arc of the longitudinal direction of the upper sliding channel 21 is larger than the radius curvature ($r_T$) of the arc section of the lower sliding channel 11, if the horizontal force applied to the upper sliding plate 20 exceeds the friction force between the surface of the upper sliding channel 21 and the contact surface of the upper slider 33, the upper slider 33 starts to slide along the upper sliding channel 21.

Figure 8A:
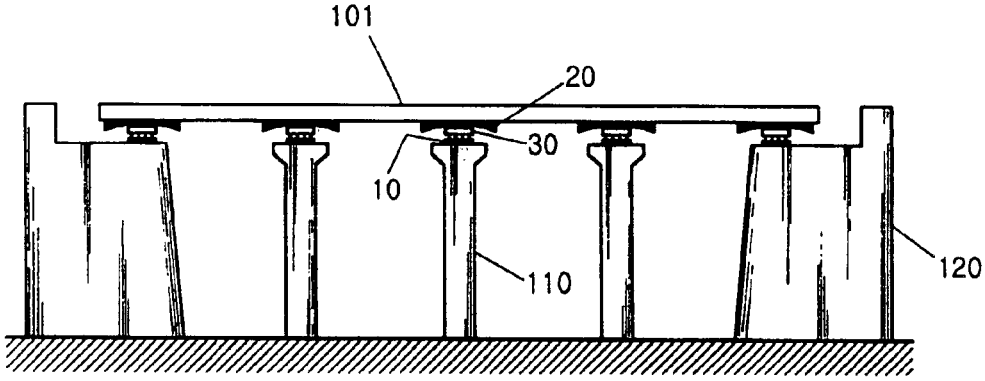
FIGS. 8*a* through 8*d* are explanation views of an operational relationship of the seismic isolation systems according to the present invention.
Figure 8B:
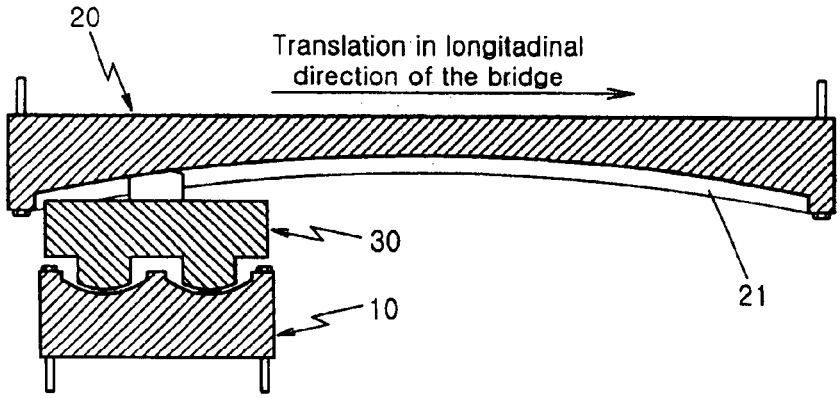
Figure 8C:
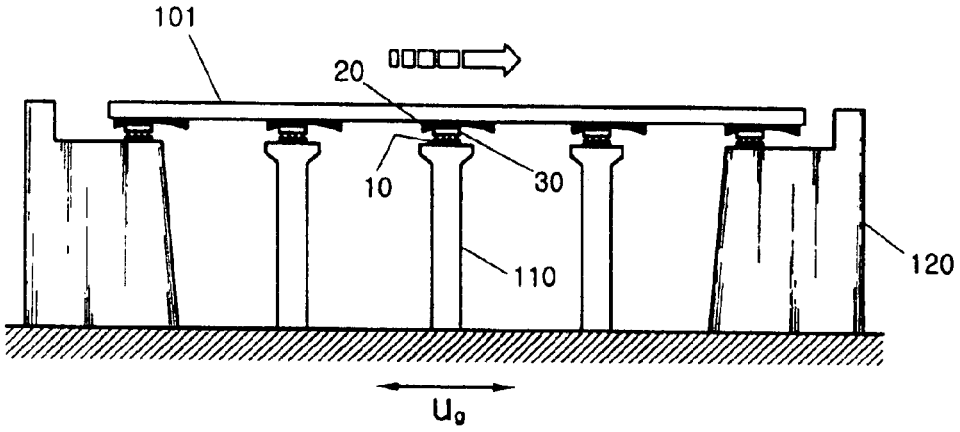

Therefore, if the earthquake motion is applied in the bridge shown in FIG. 8*c* and the seismic force, which exceeds the friction force between the surface of the upper sliding channel 21 and the contact surface of the upper slider 33, is applied to the superstructure 101 of the bridge in the longitudinal direction of bridge, the sliding assembly 30 moves along the upper sliding channel 21 (see FIG. 8*b*). Thus, the superstructure 101 of the bridge moves in the longitudinal direction of bridge (see FIG. 8*c*). That is, the upper sliding channel 21 on the sliding assembly 30 moves in the longitudinal direction of bridge, and then, the bridge deck moves as shown in FIG. 8*c*. In this process, the sliding assembly 30 maintains the stability to the overturning as described above.

Because the superstructure 101 of the bridge moves in a horizontal direction relative to the pier even though the earthquake motion is applied to the superstructure 101 of the bridge, very small amount of earthquake force will be transmitted to the pier in comparison with a case that a fixed bearing is used. Therefore, if the seismic isolation system according to the present invention is installed on the structure, the influence of the earthquake motion directly applied to the structure is very small when the earthquake motion is applied.

Figure 8D:
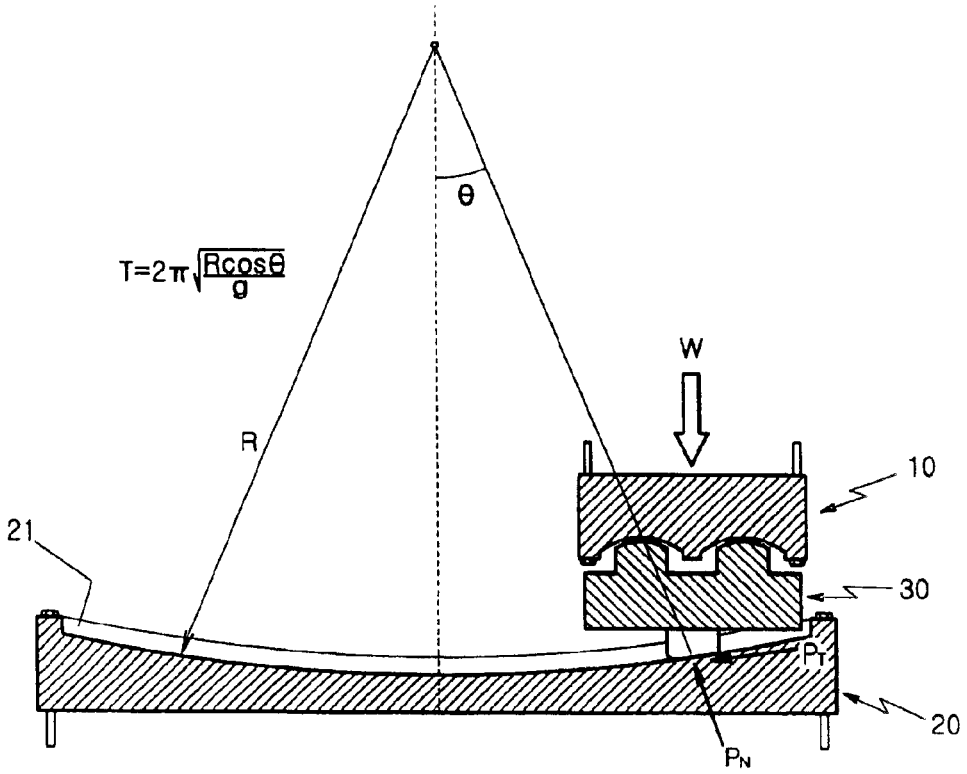

FIG. 8*d* is an upside down view of FIG. 8*b*. The sliding of the sliding assembly 30 duet to a lateral movement of the upper sliding plate 20 caused by an external load, such as earthquake, may be modeled as the pendulum motion of the sliding assembly 30 taken along the upper sliding channel 21, as shown in FIG. 8*d*.

If the upper slider 33 moves from the neutral position to a predetermined angle (θ) by sliding along the upper sliding channel 21, the restoring force ($P_T$) for restoring to the neutral position by a pendulum effect is applied. The pendulum motion of the sliding assembly 30 is stopped by an energy loss due to the friction between the upper slider 33 and the upper sliding channel 21, and thereby also the movement of the structure by the seismic force is stopped.

If the friction coefficient between the upper slider 33 and the upper sliding channel 21 is zero, the upper slider 33 performs a free pendulum motion along the upper sliding channel 21 in FIG. 8*b*. The period (T) of the pendulum motion can be calculated approximately by the following equation (1).

$$T = 2\pi\sqrt{\frac{R\cos\theta}{g}} \tag{1}$$

In the equation (1), if the angle (θ) moved from the neutral position is a value close to zero, the period (T) is increased in proportion to the square root of the radius of curvature ($R_L$) of the upper sliding channel 21. In the equation (1), "g" means an acceleration of gravity.

Like the above embodiment, the seismic isolation system of the present invention is not restricted by the installation space because the upper sliding plate 20 is mounted on the superstructure 101 of the bridge and the lower sliding plate 10 is mounted on the pier. Therefore, the radius of curvature ($R_T$ and $R_L$) of the sliding channel 11 and 21 formed on the sliding plate 10 and 20 can be increased.

Figure 1A:
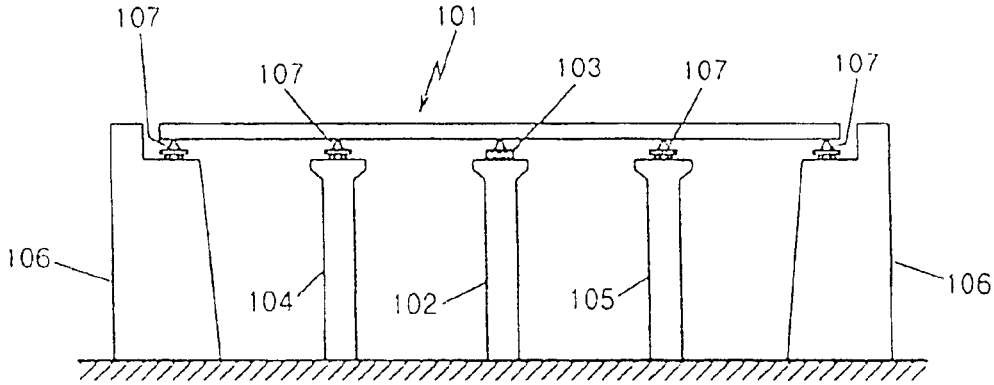
Fig. 1a (Prior Art)
FIG. 1*a* is a schematic view of a conventional 4-span continuous bridge.
Figure 1B:
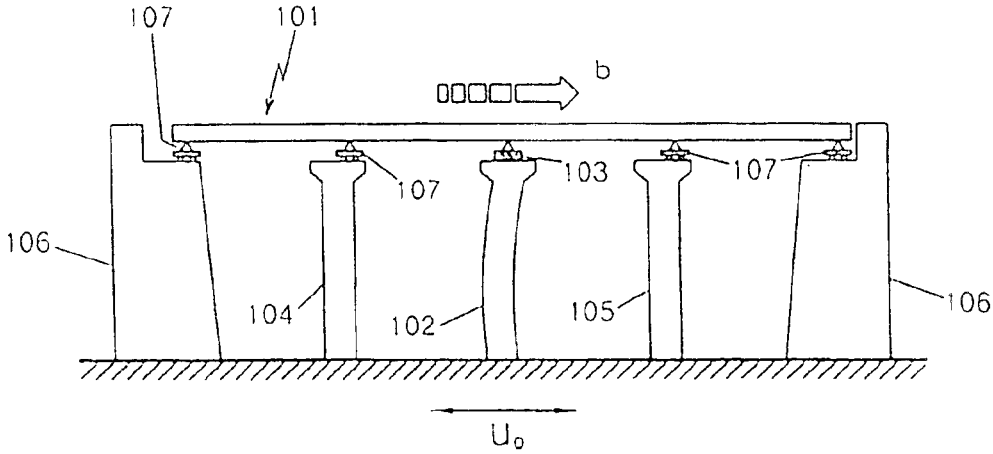
Fig. 1b (Prior Art)
FIG. 1*b* is a schematic view of the earthquake motion of the conventional 4-span continuous bridge.
Figure 2A:
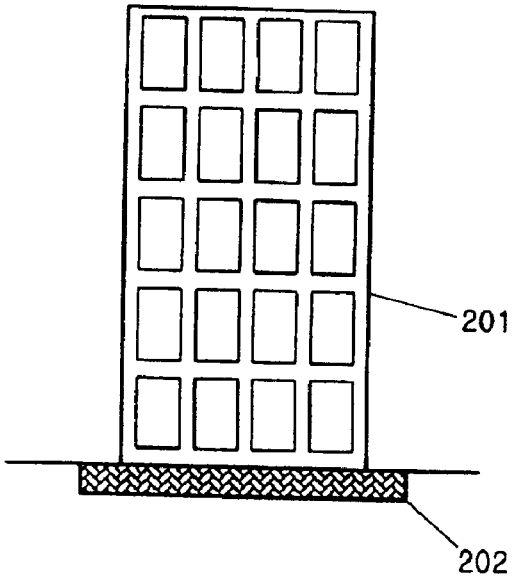
FIG. 2*a* is a schematic view of a model structure fixed on the ground.
Figure 2B:
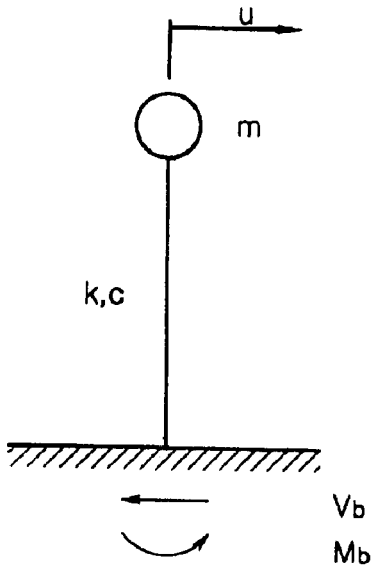
FIG. 2*b* is a schematic view of a model structure having single degree of freedom fixed on the ground.
Figure 2C:
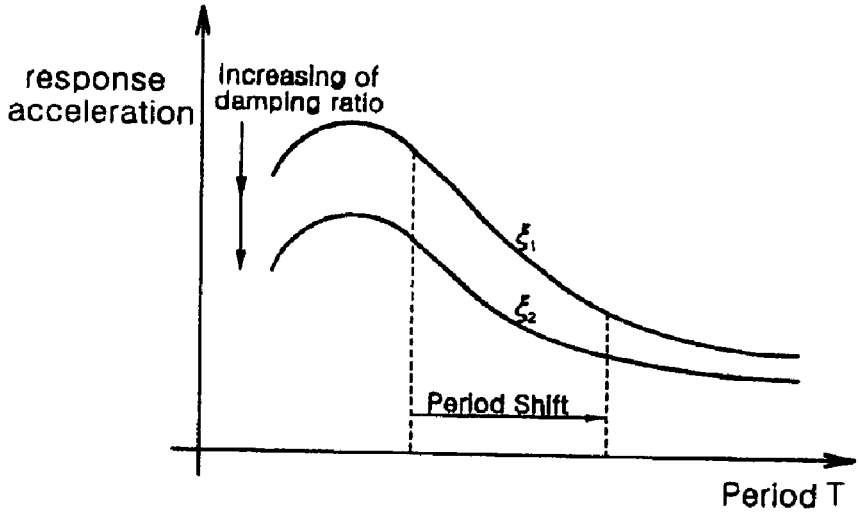
FIG. 2*c* is a graph of acceleration response spectrum.
Figure 2D:
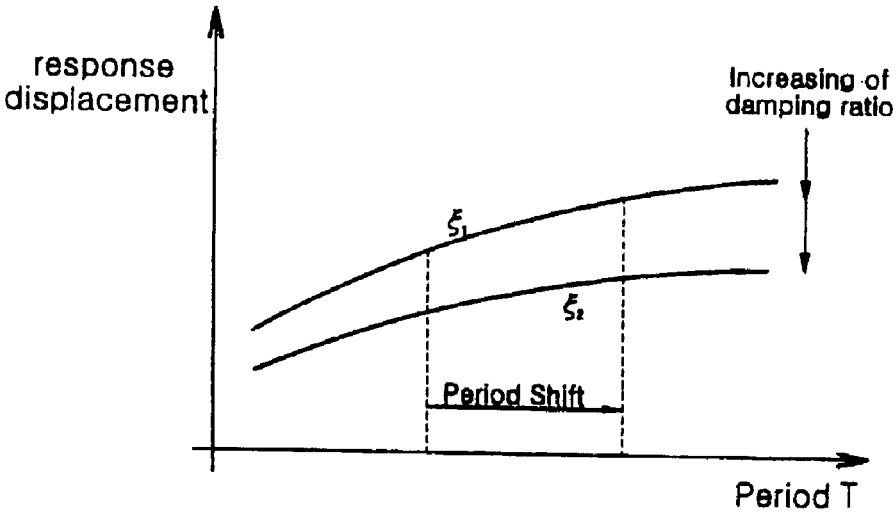
FIG. 2*d* is a graph of displacement response spectrum.
Figure 3A:
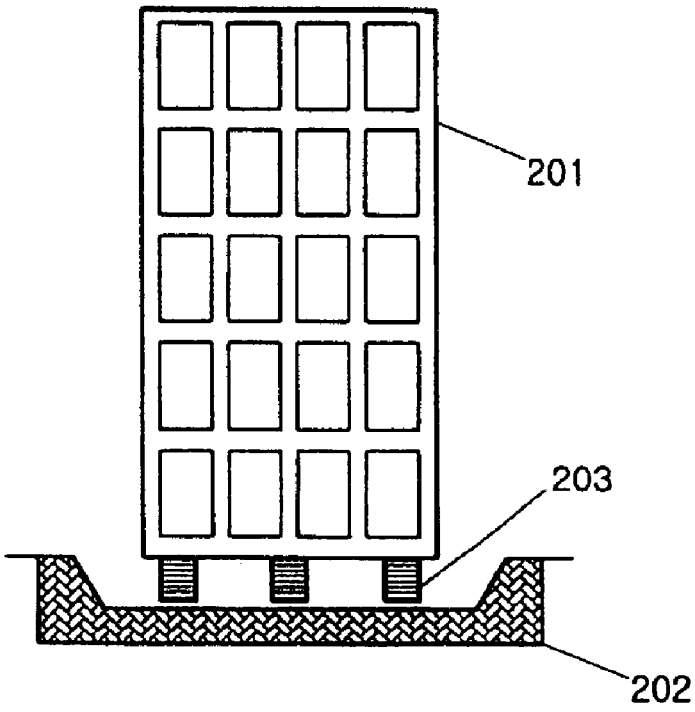
FIG. 3*a* is a schematic view of a model of seismic isolated structure.
Figure 3B:
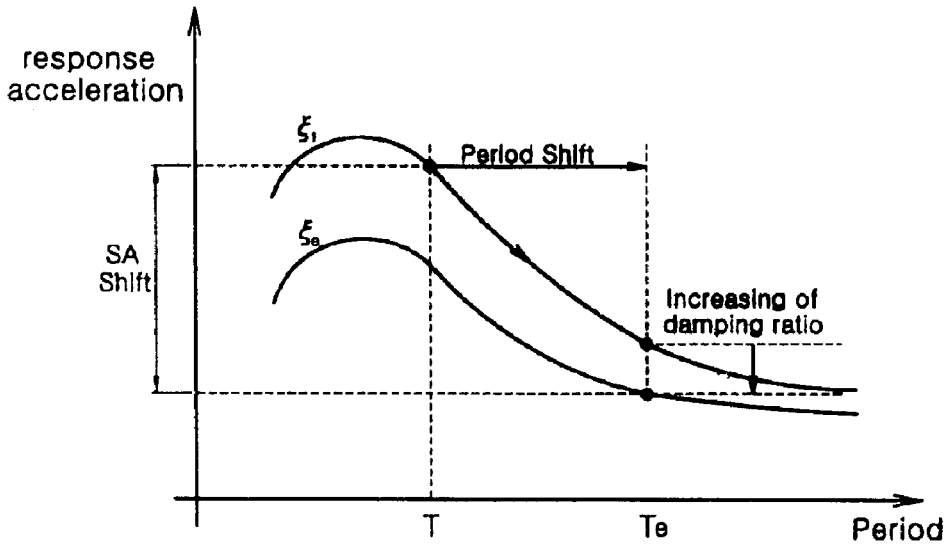
FIG. 3*b* is a graph showing the change of spectral acceleration by seismic isolation effects.
Figure 3C:
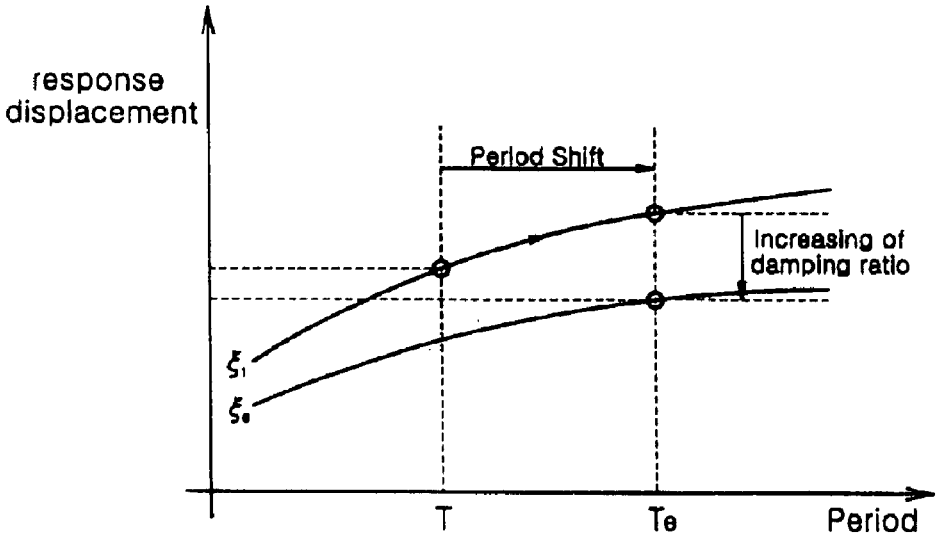
FIG. 3*c* is a graph showing the change of spectral displacement by the seismic isolation effects.

It is an advantage that the radius of curvature ($R_T$ and $R_L$) of the sliding channels 11 and 21 can be increased. In detail, in the above embodiment, if the radius of curvature ($R_L$) of the upper sliding channel 21 is increased, the natural period of the whole structural system can be increased, as can be seen from the mathematical formula 1. If the natural period is increased from T to $T_e$, the seismic force is reduced (see FIG. 3*b*). At the same time, because high energy dissipation effects (damping effects) may be obtained by adjusting the friction coefficient properly, also the displacement may be restricted. The seismic isolation system according to the present invention can reduce the seismic force, significantly compared with the conventional seismic isolation systems.

The seismic force due to the earthquake may be applied in a direction perpendicular to a longitudinal axis of bridge. If the seismic force in the direction perpendicular to the longitudinal axis of bridge is applied to the superstructure 101 of the bridge, the lower slider 32 of the sliding assembly 30 performs the free pendulum motion along the lower sliding channel 11 similar to the above, thereby reducing the seismic force in the direction perpendicular to the longitudinal axis of bridge. The seismic isolation system of the present invention has independent seismic force reducing effects to the two directions simultaneously.

In the above embodiment, the seismic isolation system is installed to have seismic force reducing effects in the longitudinal direction of bridge and the direction perpendicular to the longitudinal axis, but the installation directions of the lower sliding plate 10 and the upper sliding plate 20 may be selected freely.

Especially, the seismic force applied in an arbitrary direction may be decomposed into the longitudinal direction of bridge and the direction perpendicular to the longitudinal axis. Seismic force in each direction can be reduced by the above principle. In the bi-directional sliding pendulum seismic isolation system of the present invention, even though the lower sliding channel 11 is installed in the first direction and the upper sliding channel 21 is installed in the second direction, the upper sliding plate 20 and the lower sliding plate 10 can perform the relative motion in any directions to each other by the combination of the first direction and the second direction. Thus, effective seismic isolation actions in all horizontal directions are obtained.

Hereinafter, a modification of the sliding plate mounted on the seismic isolation system of the present invention will be described.

Figure 9A:
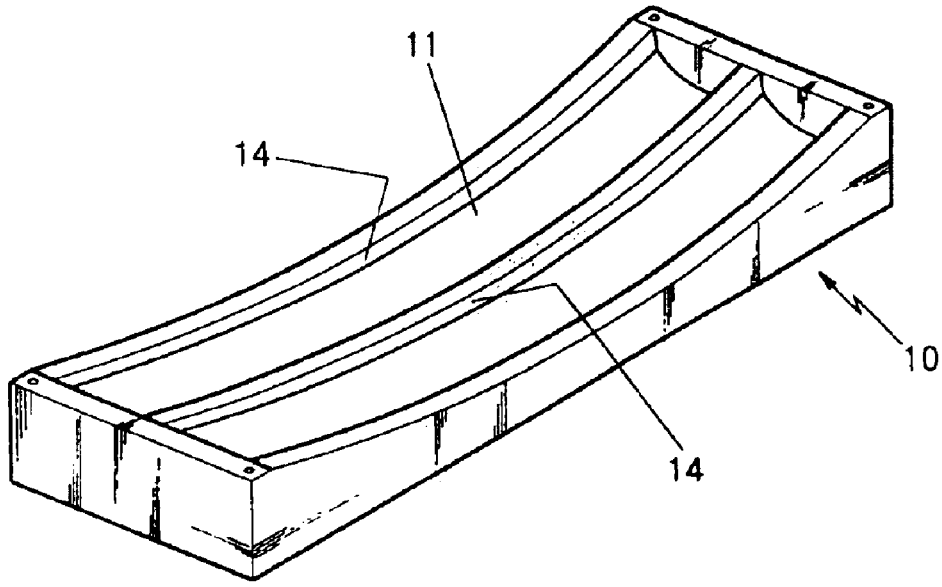
FIG. 9*a* is a schematically perspective view of another embodiment of the sliding plates of the seismic isolation system.

FIG. 9*a* is a perspective view of the lower sliding plate 10 having an escape prevention sill 14 for preventing the lower slider 31 of the sliding assembly 30 from escaping the lower sliding channel 1 when the sliding assembly 30 slides along the lower sliding channel 11. The escape prevention sill 14 may be formed between two lower sliding channels 11 and/or at both sides of each sliding channel 11.

Figure 9B:
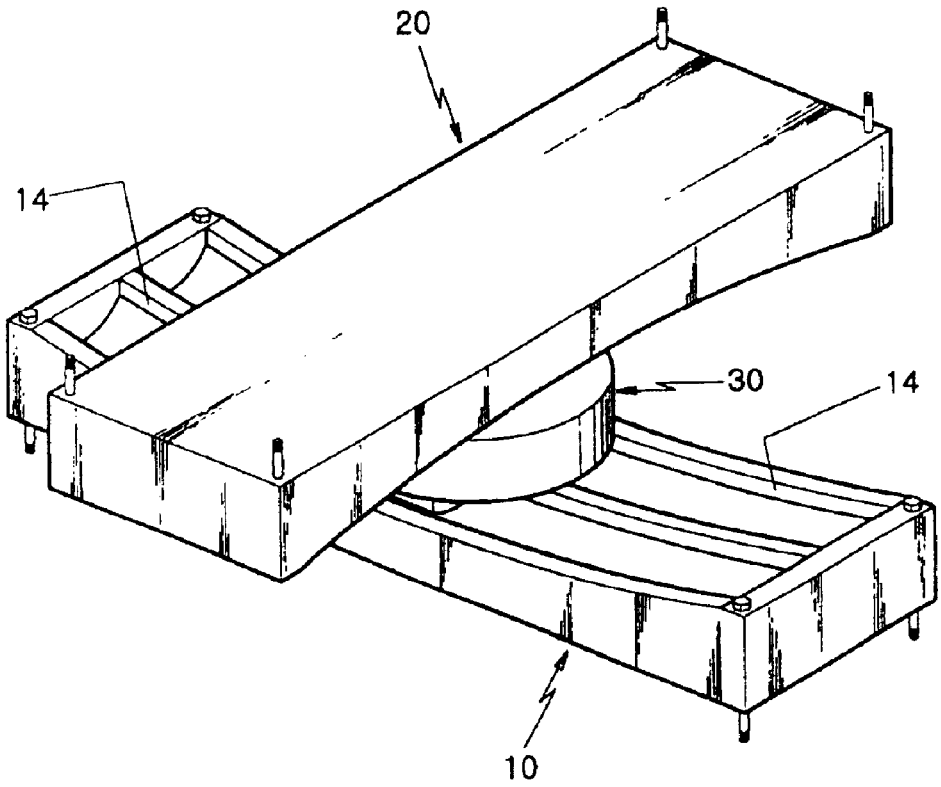
FIG. 9*b* is a perspective view of sliding plates of the seismic isolation systems.

The upper sliding plate 20 also has the escape prevention sill, like the lower sliding plate 10. FIG. 9*b* schematically shows a coupled state of the lower sliding plate 10 and the upper sliding plate 20 having the escape prevention sills.

Referring to FIGS. 10*a* through 17*b*, various modifications of the sliding assembly 30 used in the seismic isolation system of the present invention will be described.

The sliding assembly 30 of the present seismic isolation system can be a type separable into upper and lower parts. The upper and lower parts may be manufactured separately and combined. The separable sliding assembly 30 includes an upper plate type main body 35 having the upper sliders 33, a lower plate type main body 34 having the lower sliders 32, and elastic or elasto-plastic objects 36 inserted between the upper and lower main bodies 34 and 35.

Figure 10A:
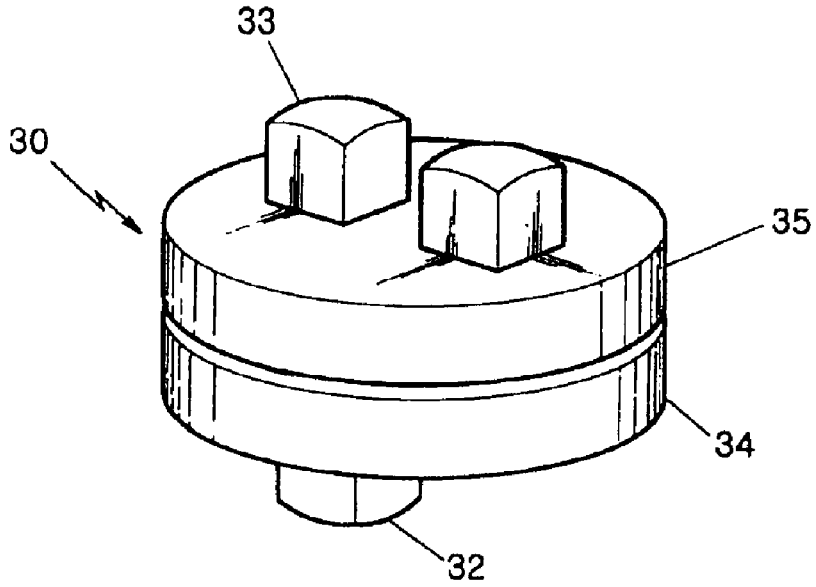
FIGS. 10*a* through 10*e* are schematic views of an embodiment of a separable sliding assembly.
Figure 10B:
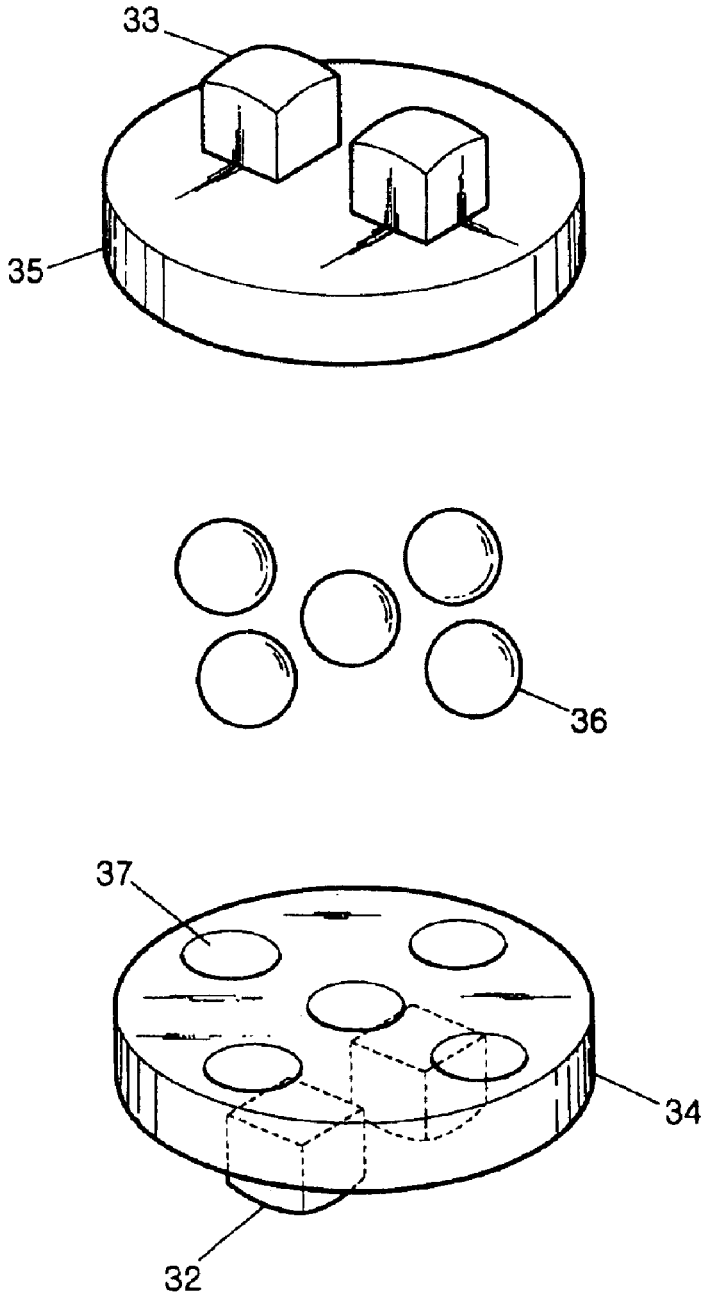
Figure 10C:
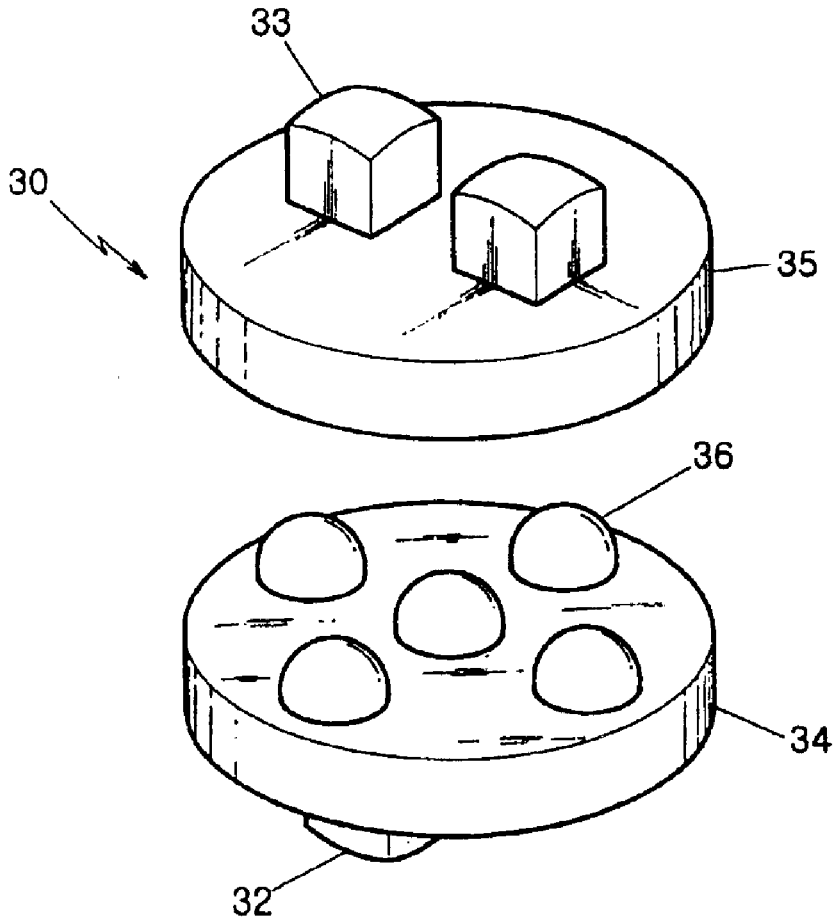
Figure 10D:
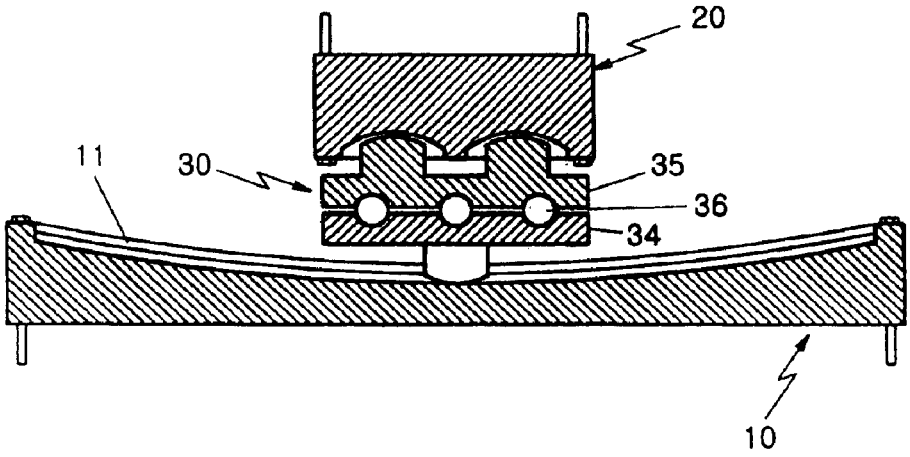
Figure 10E:
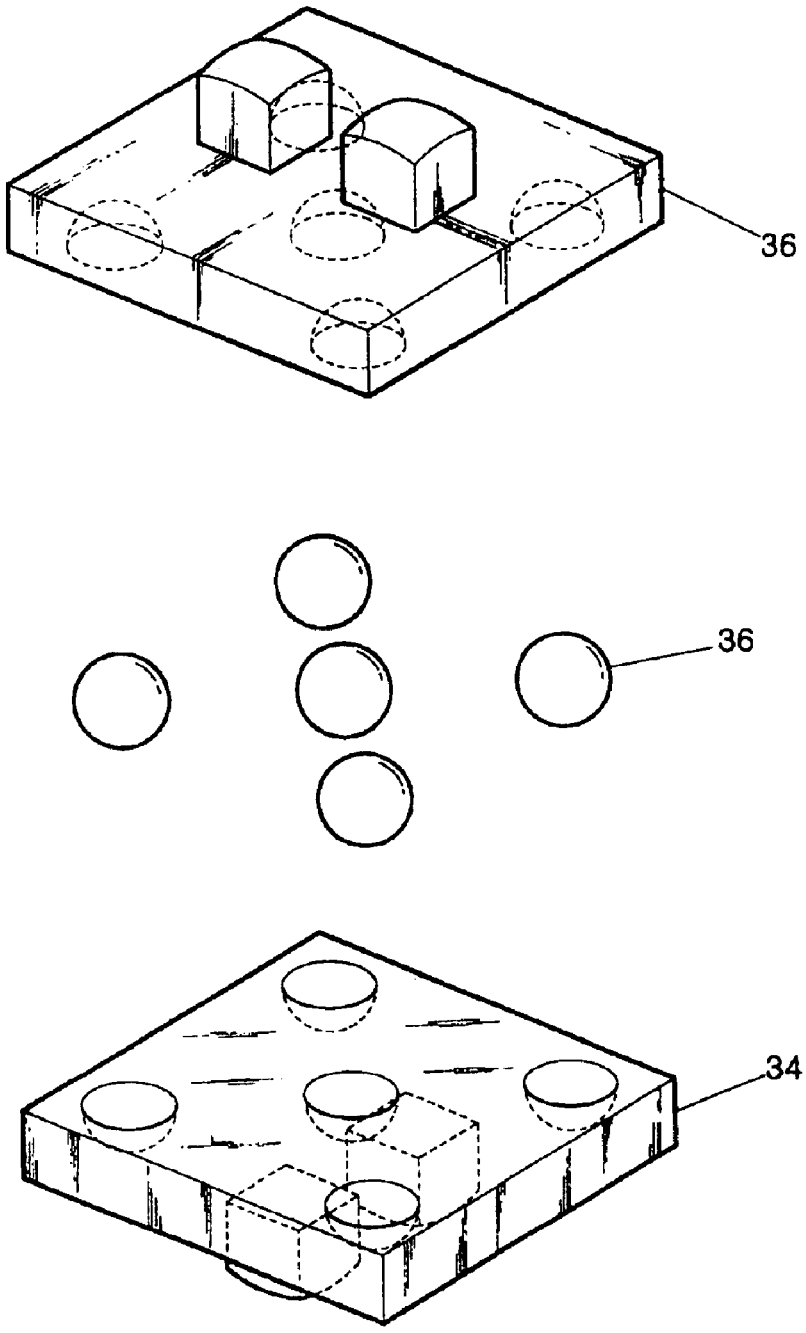
Figure 11A:
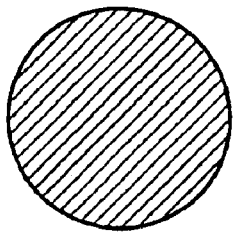
FIGS. 11*a* through 11*d* are sectional views of various embodiments of disc shape elastic or elasto-plastic objects of the separable sliding assembly.
Figure 11B:
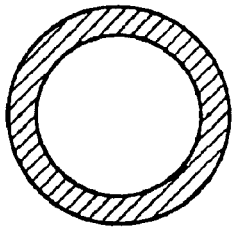
Figure 11C:
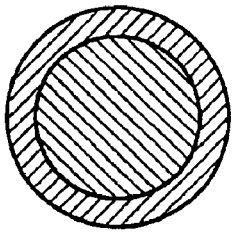
Figure 11D:
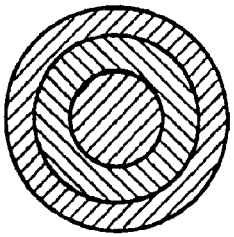

FIGS. 10*a* through 10*e* show examples of the separable sliding assembly 30. In this embodiment, the elastic or elasto-plastic objects 36 are spheres having a predetermined elasticity and damping capacity. The lower and upper main bodies 34 and 35 have holes 37 formed in the form of a hemisphere respectively to house the spherical elastic or elasto-plastic objects 36. FIG. 10*d* is a sectional view of the seismic isolation system that employs the separable sliding assembly 30 with the elastic or elasto-plastic objects 36. The lower and upper main bodies 34 and 35 are not restricted to the disc shape, and may be made in various shapes, such as a polygon including a rectangle, an oval, or the likes (see FIG. 10*e*).

If the separable sliding assembly 30 having the elastic or elasto-plastic objects 36 is used, because the elasticity and the damping capacity are given to the spheres, vertical seismic isolation effects can be induced and unexpected stress, which may be generated due to error in construction, can be absorbed. The spheres used as the elastic or elasto-plastic objects 36 may be solid spheres filled with appropriate materials (see FIG. 11*a*), hollow spheres (see FIG. 11*b*), dual shell type spheres filled with two kinds of contents (see FIG. 11*c*), or triple shell type spheres filled with three kinds of materials (see FIG. 11*d*). In the case of the shell type spheres, if the outermost shell is made of an elastic material and the inner shell is made of visco-elastic material, a three-dimensional seismic isolation system, which shows the vertical seismic isolation effects and damping effect, can be constructed.

Figure 12A:
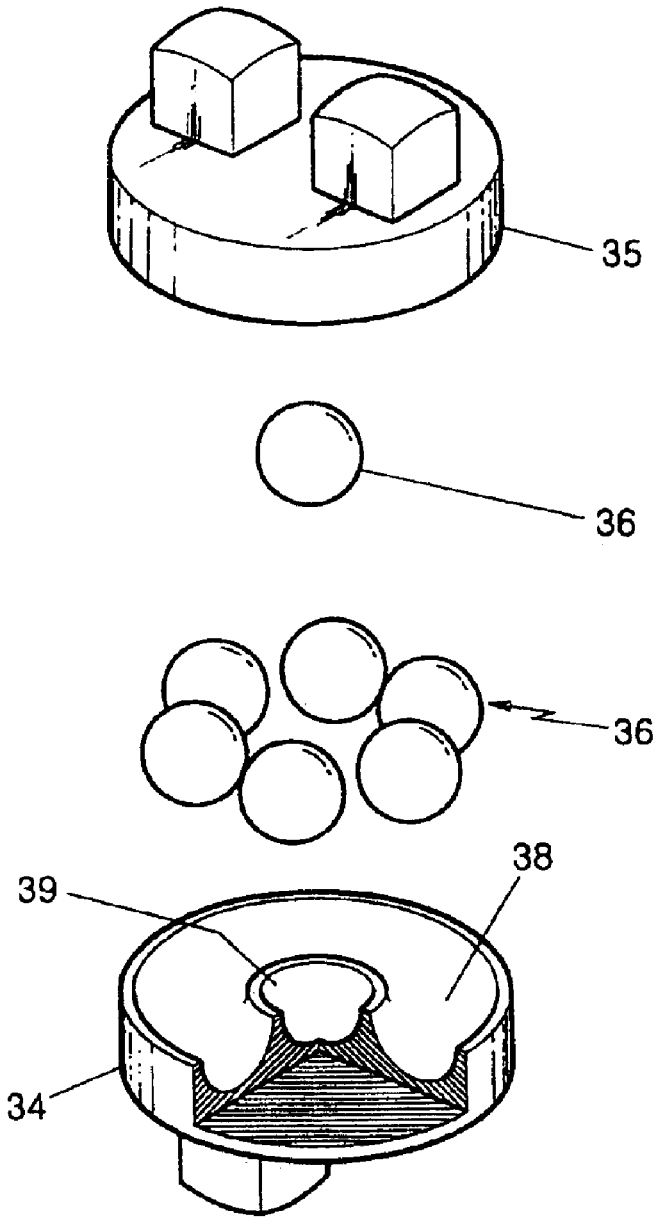
FIGS. 12*a* and 12*b* are schematic views of another embodiment of the separable sliding assembly.
Figure 12B:
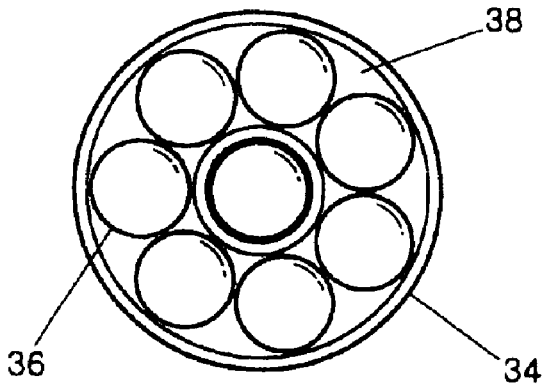

FIGS. 12*a* and 12*b* show another example of the separable sliding assembly 30. To show a contour hole 38 described later, FIG. 12*a* shows a partial cut lower main body 34. In this embodiment, the lower and upper main bodies 34 and 35 have a circular contour hole 38 formed in the inner surface and a spherical hole 39 formed at the center, and the elastic or elasto-plastic objects 36 are inserted in the contour hole 38 and the circular spherical hole 39. In the bi-directional seismic isolation system of the present invention, because the bi-directional motion is performed independently, unexpected torsional stress may be applied to the sliding assembly 30. However, in the sliding assembly 30 shown in FIGS. 12*a* and 12*b*, because the lower main body 34 and the upper main body 35 can rotate freely with respect to the vertical axis, development of the torsion stress can be prevented.

Figure 13A:
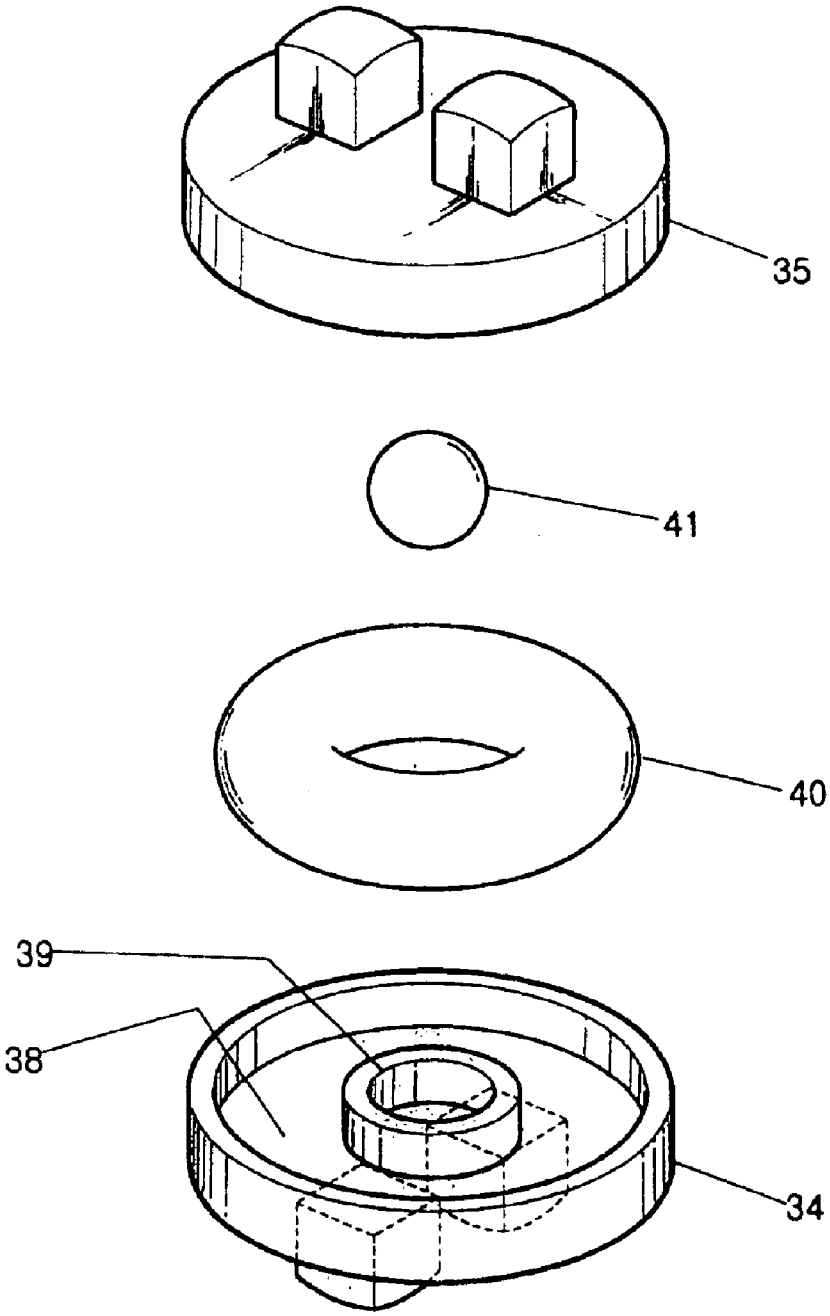
FIGS. 13*a* and 13*b* are schematic views of a further embodiment of the separable sliding assembly.
Figure 13B:
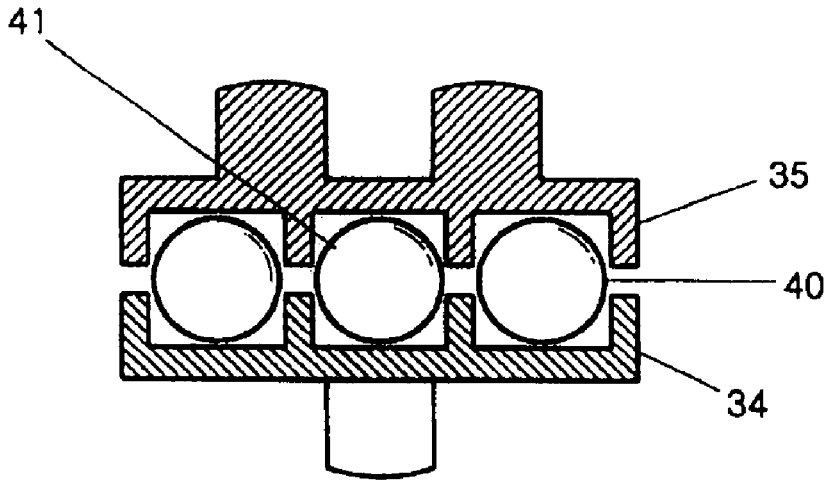
Figure 14A:
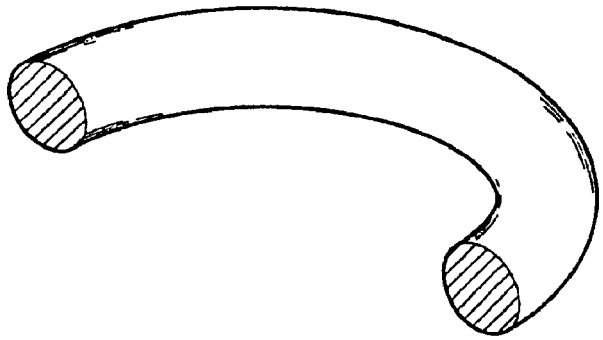
FIGS. 14*a* through 14*c* are sectional views of various embodiments of annular elastic or elasto-plastic objects of the separable sliding assembly.
Figure 14B:
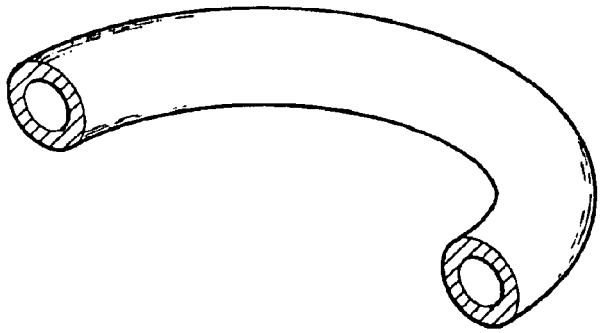
Figure 14C:
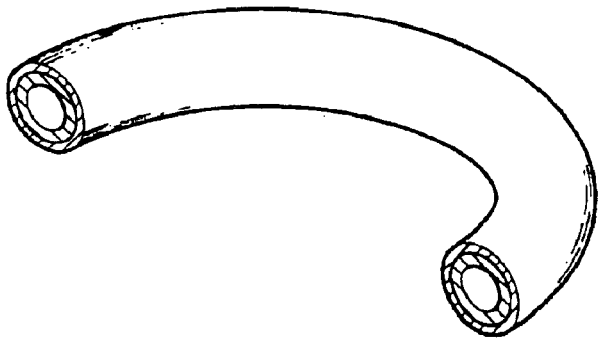

In the above modification, an annulus 40 is mounted in the contour hole 38 and a sphere 41 is mounted in the spherical hole 39 of the center thereof (see FIGS. 13*a* and 13*b*). In this case, the annulus 40 is a solid annulus filled with contents (see FIG. 14*a*), a hollow annulus (see FIG. 14*b*) or a multiple shell type annulus (see FIG. 14*c*).

Figure 15A:
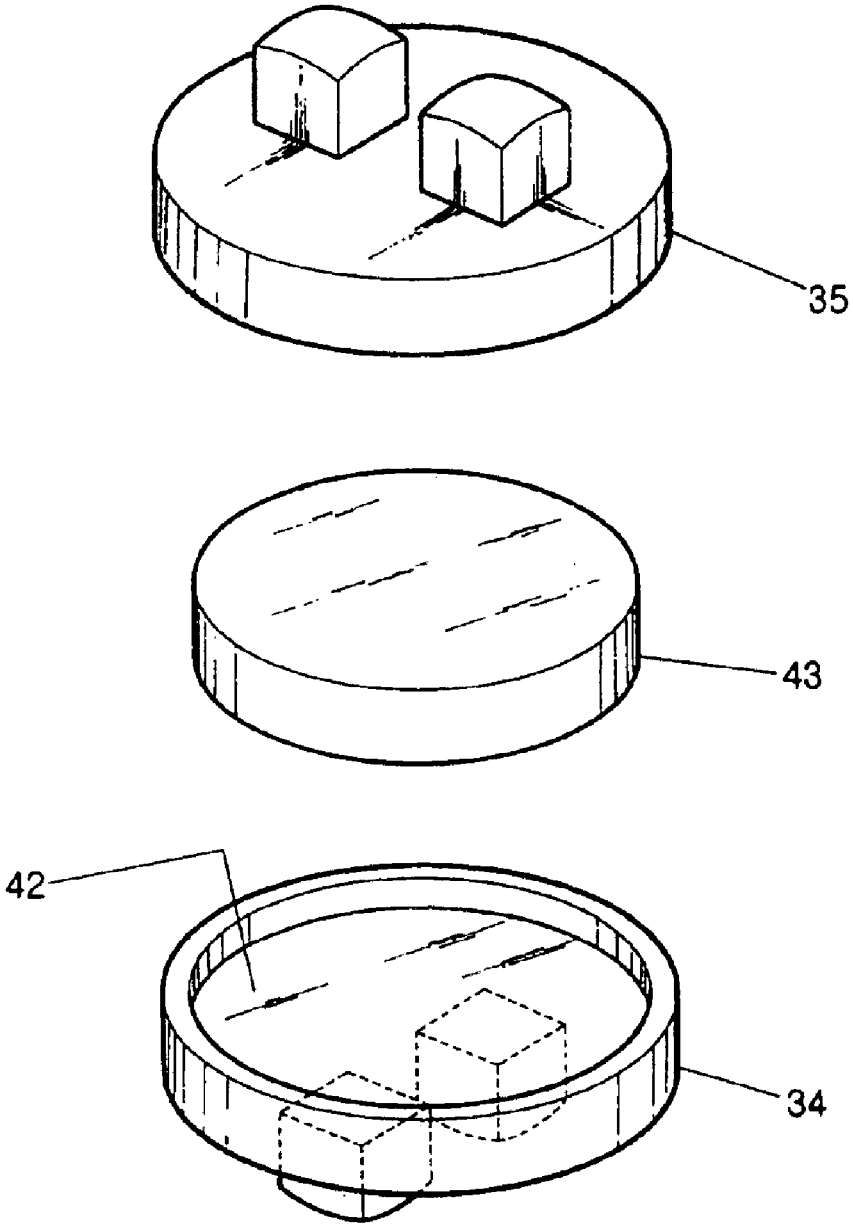
FIGS. 15*a* and 15*b* are schematic views of another embodiment of the separable sliding assembly.
Figure 15B:
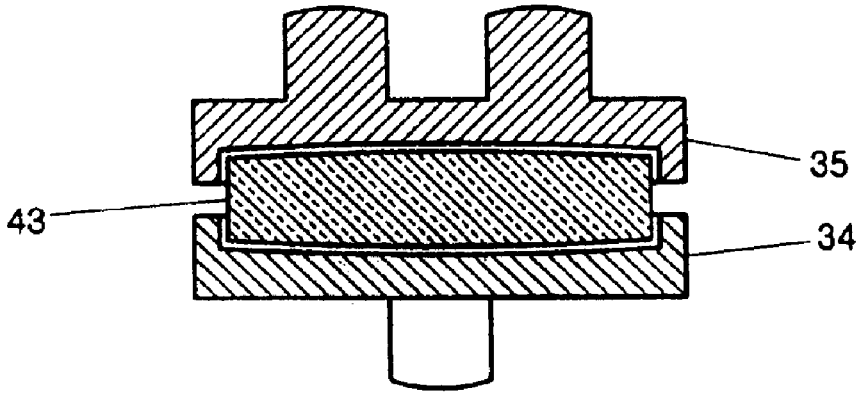
Figure 16A:
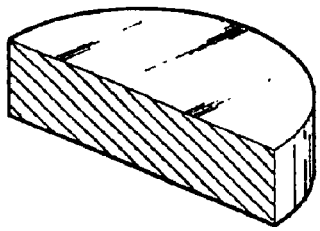
FIGS. 16*a* through 16*d* are sectional views of various embodiments of disc elastic or elasto-plastic objects of the separable sliding assembly.
Figure 16B:
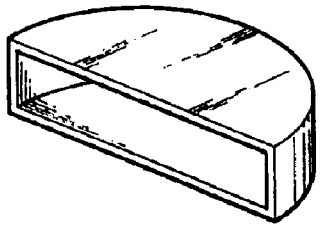
Figure 16C:
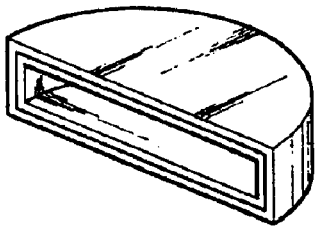
Figure 16D:
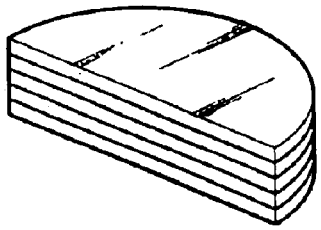

In another modification, as shown in FIGS. 15*a* and 15*b*, it is possible that the lower and upper main bodies 34 and 35 have a hole 42, and the elastic damper including a disc 43 is mounted in the hole 42. The disc 43 is a solid disc filled with contents (see FIG. 16*a*), a hollow disc (see FIG. 16*b*), a multiple shell type disc (see FIG. 16*c*), or a multi-floor disc made of elastic material of a plurality of floors (see FIG. 16*d*). It is preferable that the disc type elastic or elasto-plastic objects are made to have a curved surface at upper and lower surfaces.

Also, in the embodiment shown in FIGS. 13*a* through 15*b*, the lower main body 34 and the upper main body 35 can relatively and freely rotate around a vertical axis.

In the sliding assembly 30 of the seismic isolation system according to the present invention, the lower and upper sliders 32 and 33 in contact with the lower and upper sliding channels 11 and 21 may be also modified in various ways.

FIGS. 17*a* through 17*d* show various embodiments of the lower and upper sliders 32 and 33 used in the bi-directional seismic isolation system of the present invention. The surfaces of the lower and upper sliders 32 and 33 may be treated through a mechanical process (see FIG. 17*a*) or coated with frictional material 44 having excellent high abrasion resistance, heat resistance and the predetermined frictional properties (see FIG. 17*b*). The frictional material 44 may be selectively used from known various frictional materials according to a structural design.

Figure 17A:
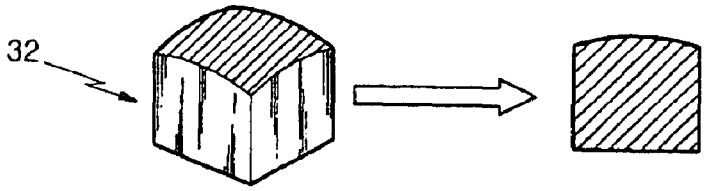
FIGS. 17*a* through 17*d* are schematic views and sectional views of various embodiments of upper and lower sliders.
Figure 17B:
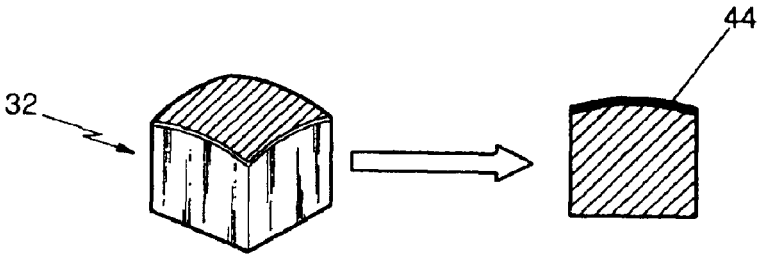
Figure 17C:
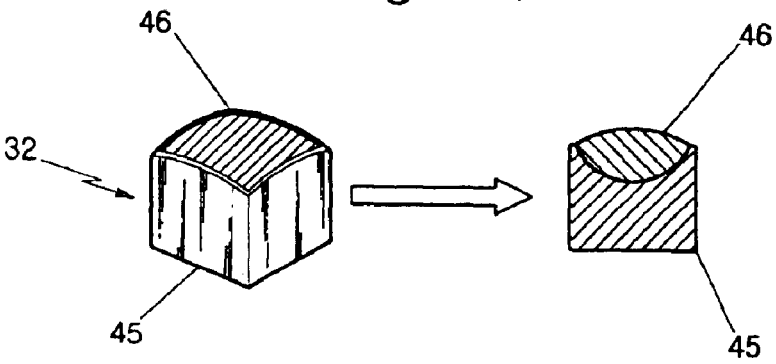
Figure 17D:
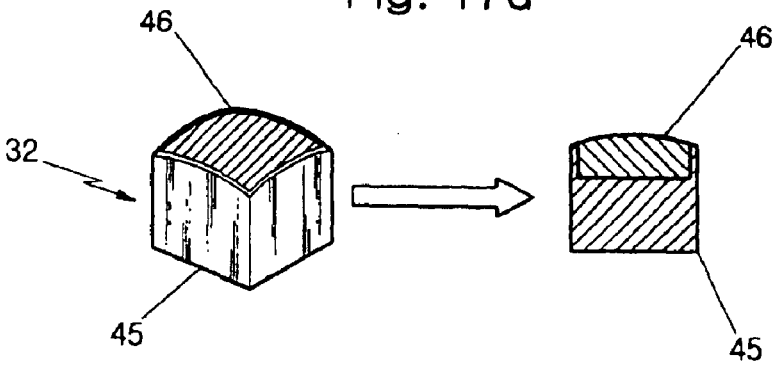

Furthermore, the lower and upper sliders 32 and 33 can be constructed as a combination of the slider support 45 and slider cores 46 having excellent frictional materials (see FIGS. 17*c* and 17*d*). In this case, it is very economical since only the slider 46 is replaced without replacing the whole sliding assembly if the frictional properties of the slider are deteriorated. The slider support 45 may be manufactured in various shapes, such as a prism, a cylinder and an elliptical cylinder, and there are no limitations.

In the present invention, the bi-directional sliding pendulum seismic isolation system is described, but the sliding pendulum seismic isolation system can be modified into a uni-directional sliding pendulum seismic isolation system.

Figure 18A:
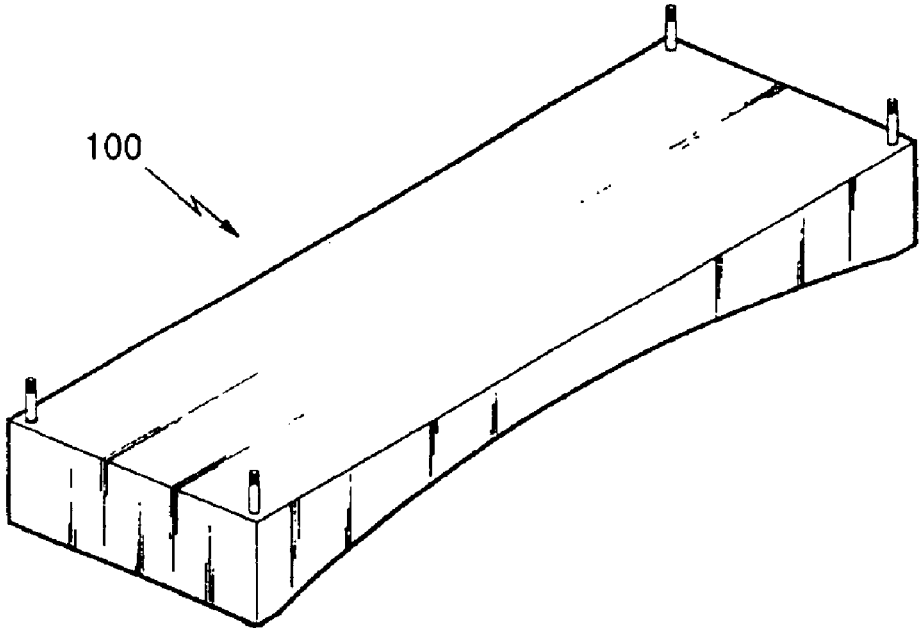
FIGS. 18*a* through 18*c* are schematic views of an embodiment of bi-directional sliding pendulum seismic isolation systems having one slider channel and one slider.
Figure 18A:
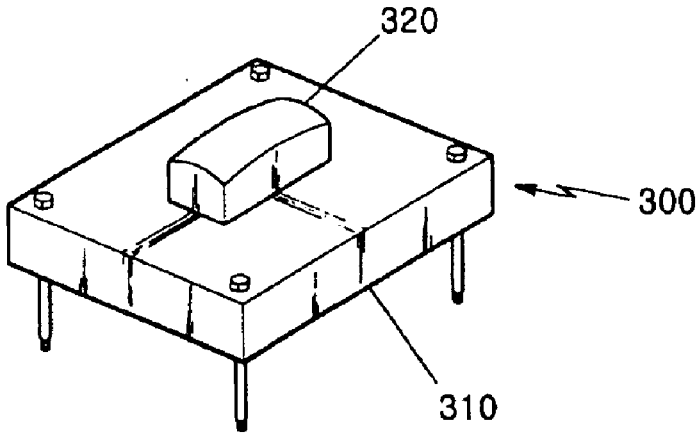
Figure 18B:
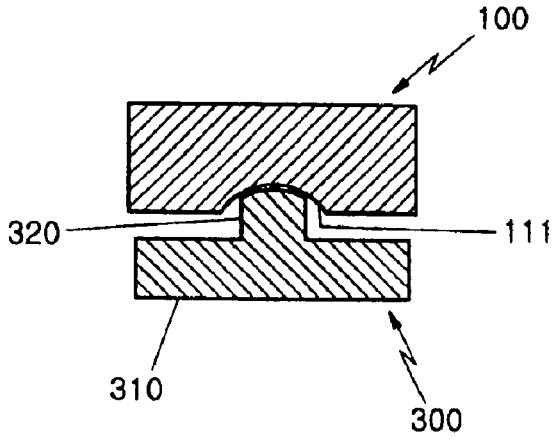
Figure 18C:
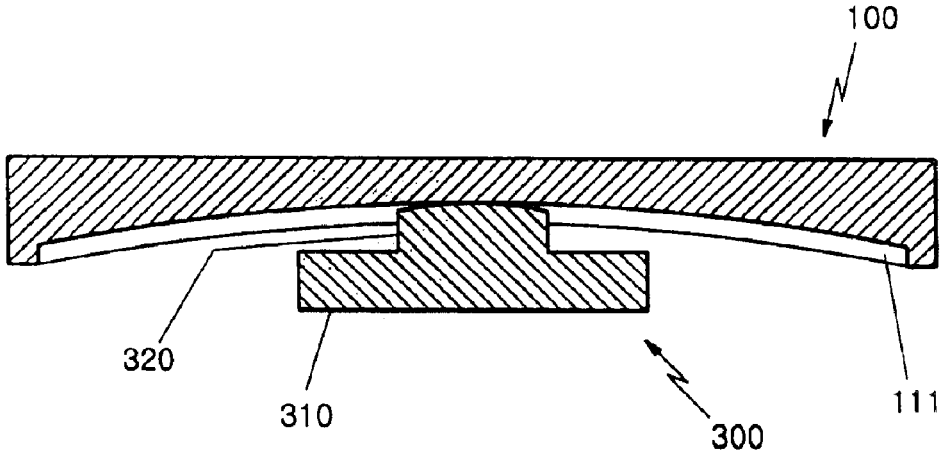
Figure 19A:
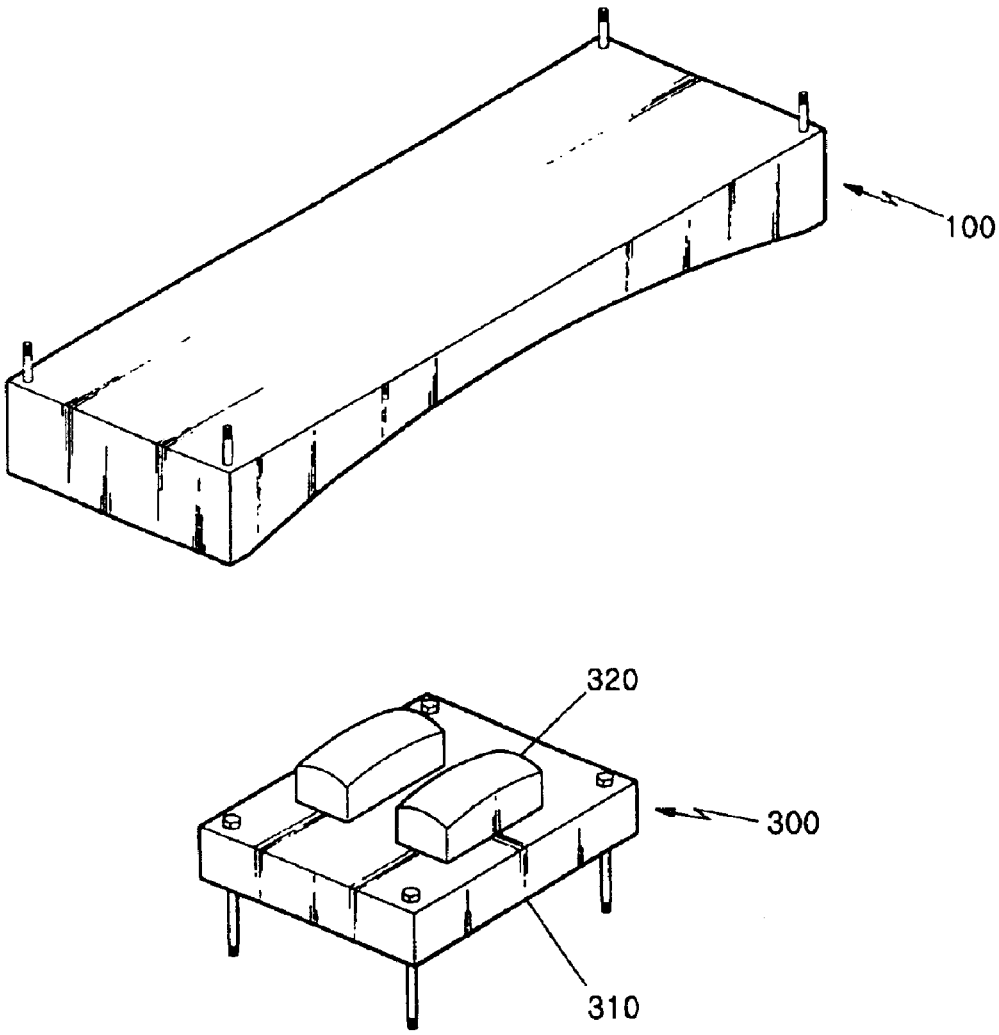
FIGS. 19*a* through 19*c* are schematic views of an embodiment of bi-directional sliding pendulum seismic isolation systems having two slider channels and two sliders.
Figure 19B:
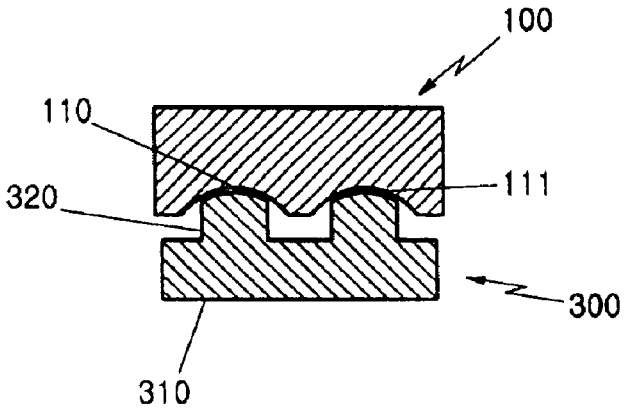
Figure 19C:
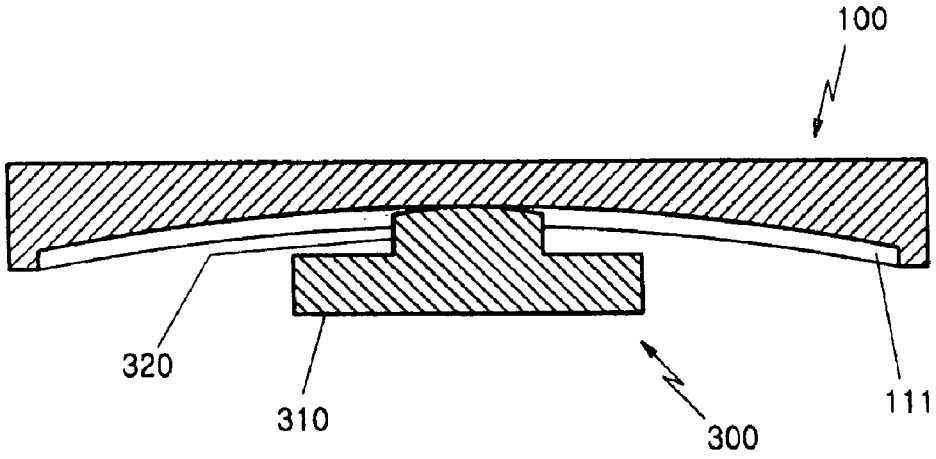

FIGS. 18*a* through 18*c* show the unidirectional sliding pendulum seismic isolation system having one sliding channel and one slider. FIGS. 19*a* through 19*c* show the uni-directional sliding pendulum seismic isolation system having two sliding channels and two sliders.

The uni-directional sliding pendulum seismic isolation system according to the present invention includes a sliding plate 100 having a sliding channel 111 forming a unidirectional sliding path, and a sliding assembly 300 performing a pendulum motion by sliding along the sliding channel 111.

The sliding plate 100 of the uni-directional sliding pendulum seismic isolation system has the same structure as the lower or upper sliding plate 10 or 20 of the bi-directional sliding pendulum seismic isolation system described above, and therefore, the detailed description will be omitted.

The sliding assembly 300 includes a plate type main body 310 and a slider 320 sliding along the sliding channel 111 of the sliding plate 100. The surface of the slider 320 of the uni-directional sliding pendulum seismic isolation system is also treated by the mechanical process or coated with appropriate material, like the bi-directional sliding pendulum seismic isolation system. Moreover, a separate slider 46 separated from the main body may be used.

The operation of the uni-directional sliding pendulum seismic isolation system is the same as the bi-directional sliding pendulum seismic isolation system, besides that the sliding pendulum motion is performed in one direction, and therefore, the description of the operation will be omitted.

Figure 20A:
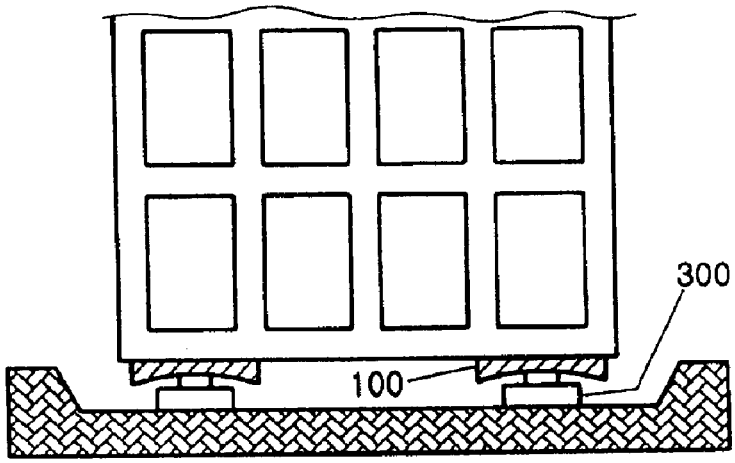
FIGS. 20*a* and 20*b* are schematic views of the bi-directional sliding pendulum seismic isolation systems applied to a structure.
Figure 20B:
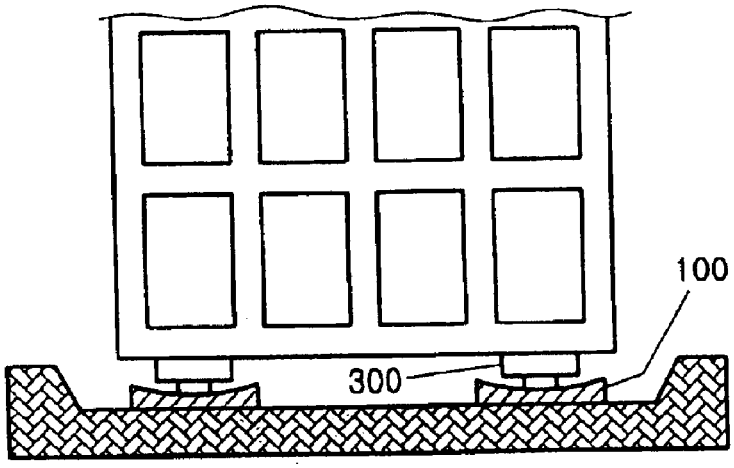

The uni-directional sliding pendulum seismic isolation system can be used to structures requiring uni-directional seismic isolation. FIG. 20*a* shows an example that the sliding plate 100 is installed on the structure and the sliding assembly 300 is installed as a base, and FIG. 20*b* shows another example that the sliding plate 100 is installed as the base and the sliding assembly 300 is installed on the structure.

The uni-directional sliding pendulum seismic isolation system may be used even when multi-axial seismic isolation is required. The uni-directional sliding pendulum seismic isolation system is installed in multi-level, wherein the sliding assembly is installed at a lower level to slide in the first direction and the sliding assembly is installed at an upper level to slide in the second direction (see FIGS. 21*a* and 21*b*). If the uni-directional sliding pendulum seismic isolation system is installed in multi-level, seismic isolation effects in all horizontal directions are shown as the sliding assemblies slides in the first and second directions.

Figure 21A:
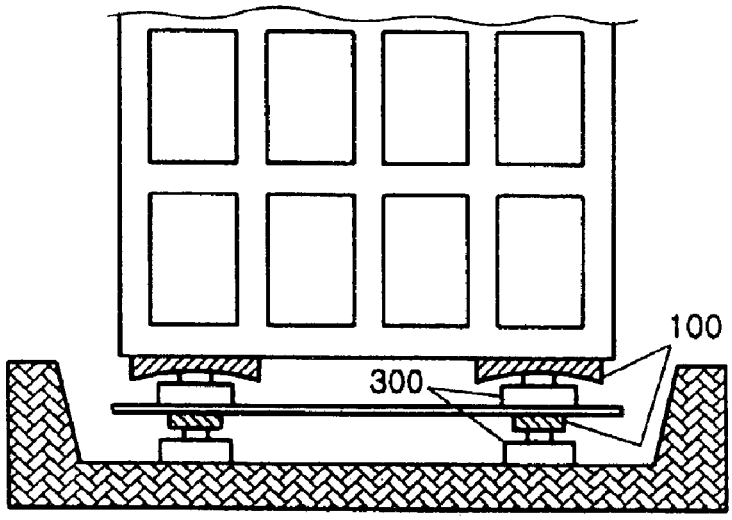
FIGS. 21*a* and 21*b* are schematic views of the bi-directional sliding pendulum seismic isolation systems applied to a structure in double layers.
Figure 21B:
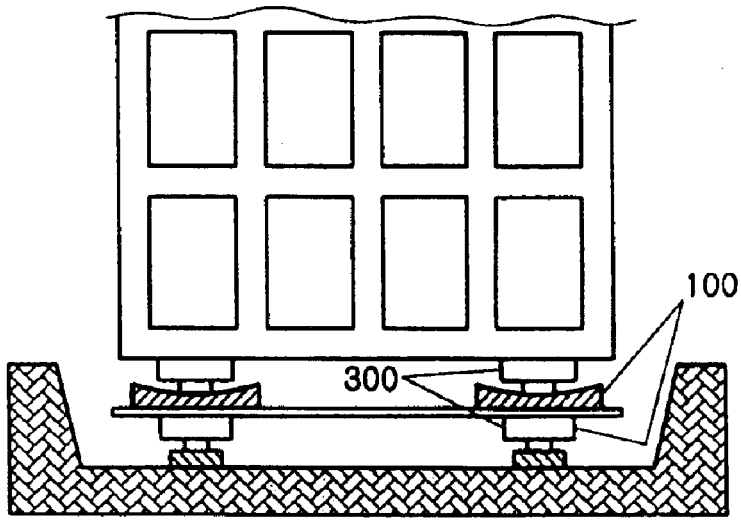

In FIG. 21*a*, the sliding plates 100 are installed to have the channels facing down while the channels may be facing up in another installation method as shown in FIG. 21*b*.

An embodiment of an articulated sliding assembly used in the directional sliding pendulum seismic isolation system of the present invention will be described.

Figure 22A:
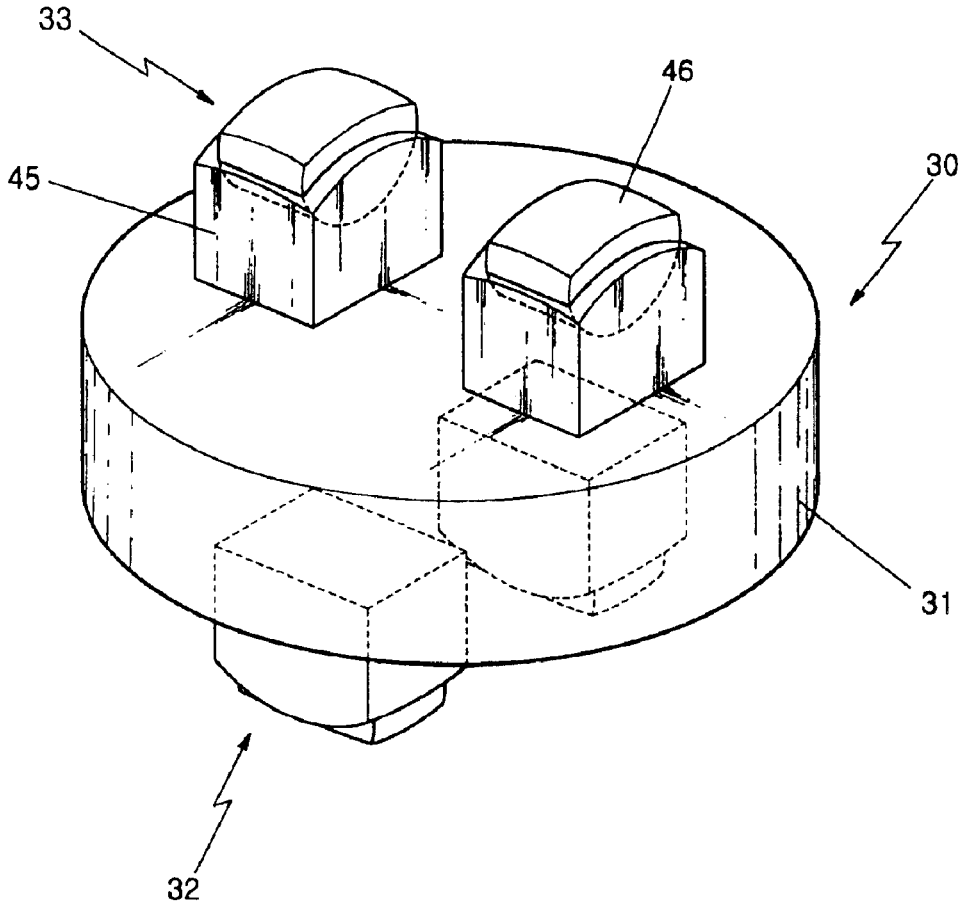
FIG. 22*a* is a perspective view of an embodiment of the sliding assembly of the present invention used in the bi-directional sliding pendulum seismic isolation systems.
Figure 22B:
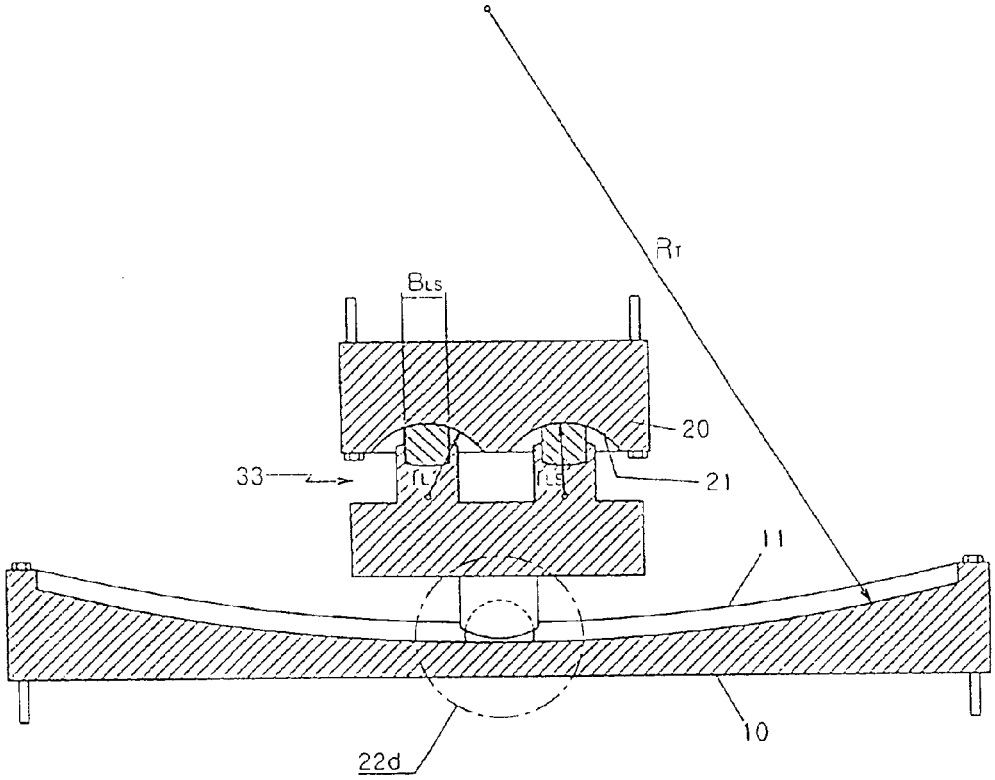
FIG. 22*b* is a sectional view of a used state of the sliding assembly shown in FIG. 22*a;*

FIG. 22*a* is a perspective view of an embodiment of the sliding assembly 30 used in the bi-directional sliding pendulum seismic isolation system. FIG. 22*b* is a sectional view of a shape that the sliding assembly 30 of FIG. 22*a* is mounted on the bi-directional sliding pendulum seismic isolation system.

The sliding assembly 30 includes the plate type main body 31, the lower slider 32 formed at the lower portion of the main body 31 and sliding along the sliding channel 11 of the lower sliding plate 10 mounted on the sliding pendulum seismic isolation system, and the upper slider 33 formed at the upper portion of the main body 31 and sliding along the sliding channel 21 of the upper sliding plate 20 mounted on the sliding pendulum seismic isolation system.

In this embodiment, the respective lower and upper sliders 32 and 33 include a rectangular slider support 45, and a semi-disc type slider core 46 inserted and mounted into the end of the slider support 45. The semi-disc type slider cores 46 are directly in contact with the sliding plates 10 and 20.

Figure 22C:
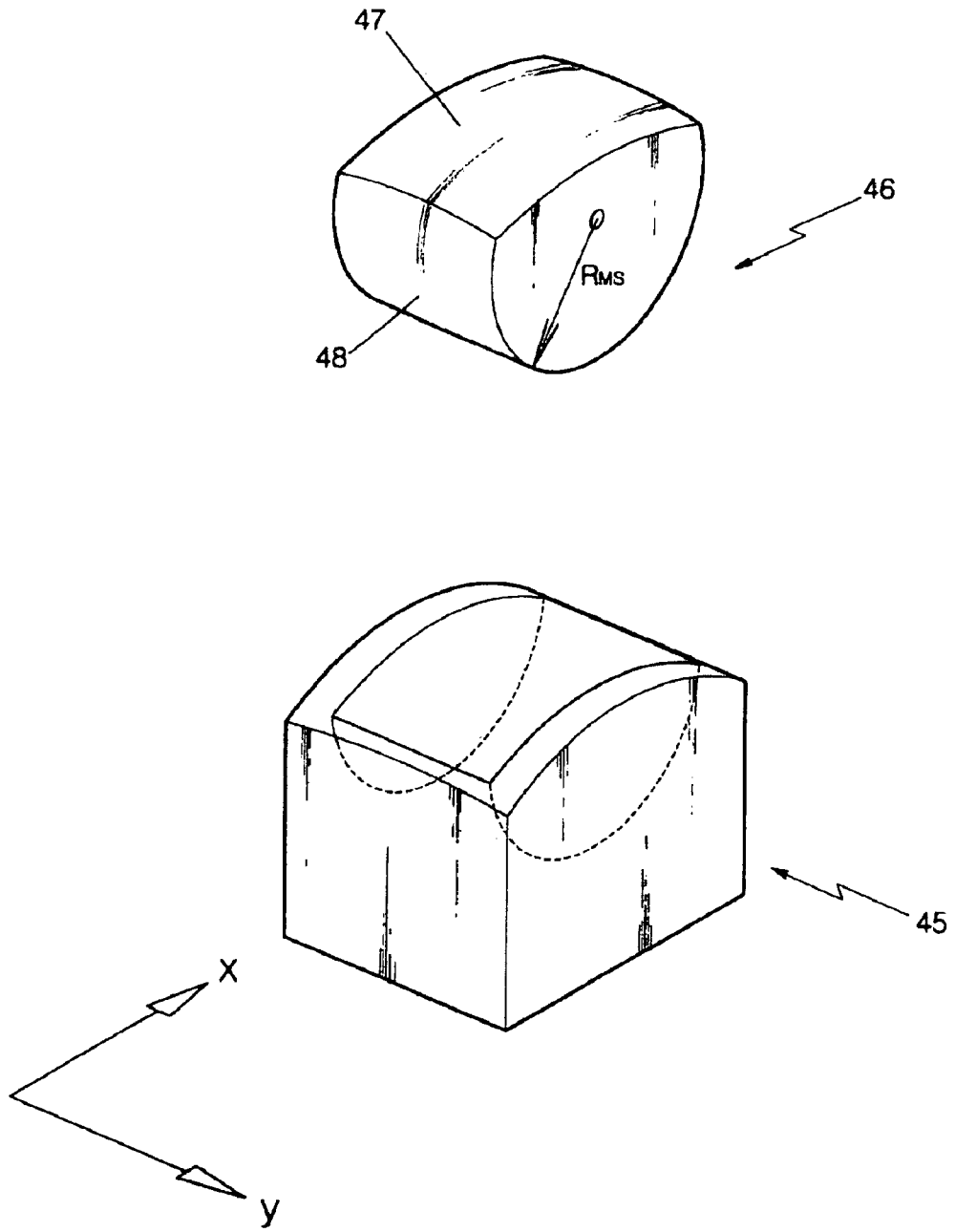
FIG. 22*c* is an exploded perspective view of an embodiment of the slider of the sliding assembly.

FIG. 22*c* is an exploded perspective view of an embodiment of the slider according to the present invention. In this embodiment, the slider core 46 mounted on the slider support 45 is in the form of a semi-disc of a predetermined thickness. The shape of the upper surface 47 in direct contact with the sliding channel of the sliding pendulum seismic isolation system is made to correspond to the radius of curvature of the sliding channel of the sliding pendulum seismic isolation system. The lower surface 48 of the slider core 46 inserted into the end of the slider support 45 is made in the form of a semi-cylinder of a predetermined diameter to rotate freely with respect to the slider support.

Figure 22D:
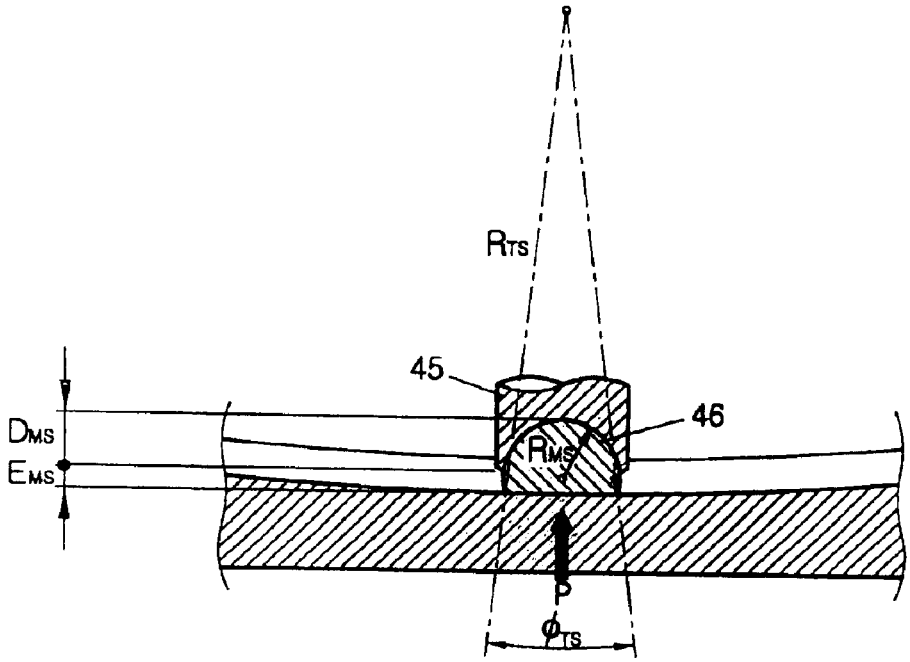
FIG. 22*d* is an enlarged sectional view of an "A" portion of FIG. 22*b;*
Figure 22E:
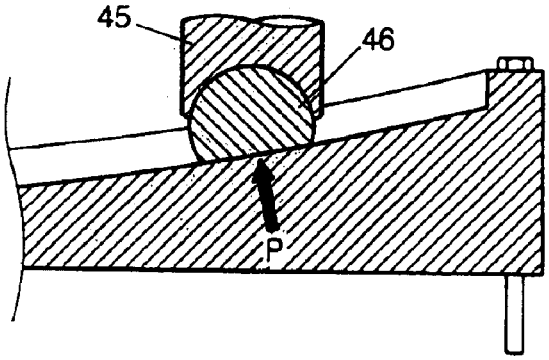
FIG. 22*e* is an enlarged sectional view of the slider when the sliding assembly is moved in an end of the slider channel.

FIG. 22*b* is a sectional view of a state that the sliding assembly of this embodiment is mounted on the bi-directional sliding pendulum seismic isolation system. FIG. 22*d* is an enlarged detailed sectional view of an "A" portion of FIG. 22*b*. FIG. 22*e* is an enlarged detailed sectional view of the slider part when the sliding assembly is located at one end of the sliding channel.

In FIG. 22*d*, $R_{TS}$ means the radius of curvature in the longitudinal direction (the x-axis direction in FIG. 22*c*) of the surface 47 of the slider core in contact with the channel 11 of lower sliding plate 10. The radius of curvature ($R_{TS}$) of the surface 47 of the slider core, which is a portion of the slider in direct contact with the sliding channel 11 , is the same as or smaller than the radius of curvature ($R_T$) of a longitudinal direction of the sliding channel 11 of the lower sliding plate 10. The radius of curvature of the surface 47 of the slider core, which is a portion of the slider in direct contact with the sliding channel 21 of the upper sliding plate, is denoted as $R_{LS}$. It is the same as or smaller than the radius of curvature ($R_L$) of a longitudinal direction of the sliding channel 21 of the upper sliding plate 20. In FIG. 22*d*, $\Phi_{TS}$ means the inner angle of the arc of the upper surface 47 of the slider core in contact with the channel 11. The inner angle of the arc of the upper surface 47 of the slider core in contact with the channel 21 in the upper sliding channel 20 will be denoted as $\Phi_{LS}$. $D_{MS}$ means the depth that the slider core 46 is buried in the slider support 45 and $E_{MS}$ means a value that the depth ($D_{MS}$) is subtracted from a height of the whole slider core 46. $R_{MS}$ means the radius of curvature of the surface 48 (see FIG. 22*c*) of the slider core 47.

In FIG. 22*c*, the surface 48 of the slider core is inserted into the end of the slider support 45 of the sliding assembly and in the form of a semi-cylinder in such a manner that the slider core 46 freely rotate around an axis at right angles to the sliding channel inside the slider support 45, i.e., around y-axis of FIG. 22*c*. The slider core 46 has a predetermined radius of curvature in an axial direction perpendicular to the sliding channel, i.e., in the thickness direction (in a y-axis direction in FIG. 22*c*).

As shown in FIG. 22*b*, the surface 47 of the slider core in contact with the channel of upper sliding plate has the radius of curvature of $r_{LS}$ in the thickness direction, wherein the radius of curvature ($r_{LS}$) of the thickness direction of the surface has a value that is the same as or smaller than the radius of curvature ($r_L$) of the thickness direction of the sliding channel 21. The surface 48 of the slider core may be formed without the radius of curvature in the thickness direction. In FIG. 22*b*, $B_{LS}$ means a thickness of the slider core 46.

Detailed dimensions of the slider core 46 that is in contact with the channels 21 in the upper sliding plate 20, i.e., the radius of curvature ($R_{LS}$, $r_{LS}$) of the surface 47, the radius of curvature ($R_{MS}$) of the surface 48, the arc angle ($\Phi_{TS}$) of the upper surface, the thickness ($B_{LS}$) and the buried depth ($D_{MS}$), are determined according to dimensions of the sliding channel of the sliding pendulum seismic isolation system. Detailed dimensions of the slider core 46 that is in contact with the channels 11 of the lower sliding plate 10 can be determined in the same way. To reduce friction between the slider core 46 and the sliding channel 11 and friction between the slider core 46 and the slider support 45, preferably, each friction surface is coated with coating material of a small friction coefficient, which can be obtained in the market, for example, "TEFLON®."

In this embodiment, because the surface 48 of the slider core 46 freely rotates inside the slider support 45, when the sliding assembly 30 slides in the sliding channels 11 and 21, the surface of the slider core 46 of the sliding assembly being in contact with the sliding channels 11 and 21 can remain unchanged. That is, as shown in FIG. 7*e*, because the slider core 46 rotates even though the sliding assembly 30 moves from the sliding channels 11 and 21 to both ends of the sliding channel, a contact area between the slider core 46 and the sliding channel is kept uniform, and thus compressive force (P) is always transferred through the center of the slider. Therefore, the movement of the sliding assembly 30 is performed in a more stable state.

Referring to FIGS. 23*a* through 23*d*, another embodiment of the sliding assembly of the present invention will be described.

Figure 23A:
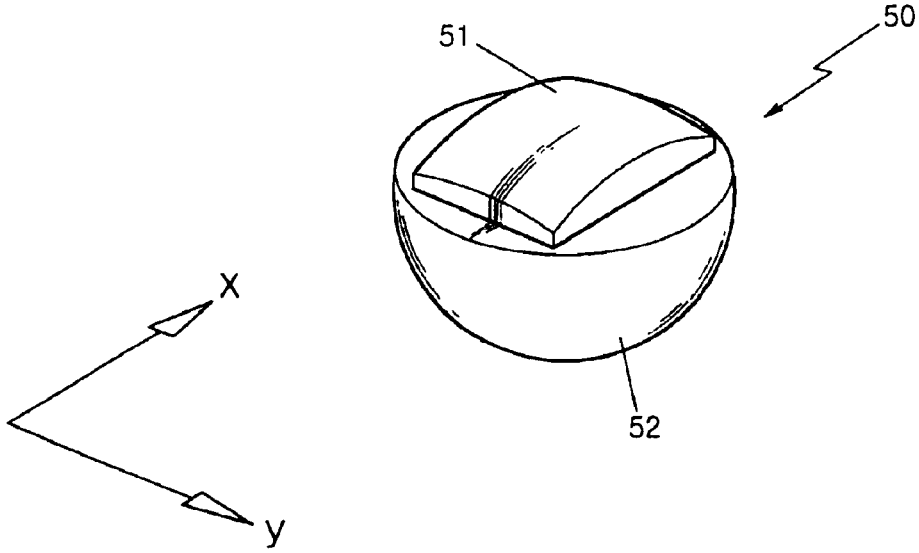
FIG. 23*a* is a perspective view of a slider core of the sliding assembly according to another embodiment.
Figure 23B:
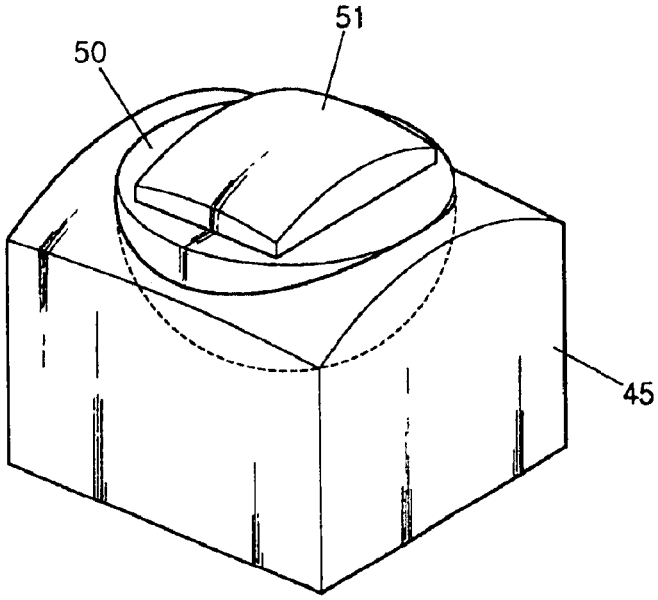
FIG. 23*b* is a schematic view of a form that the slider core is coupled to a slider support.
Figure 23C:
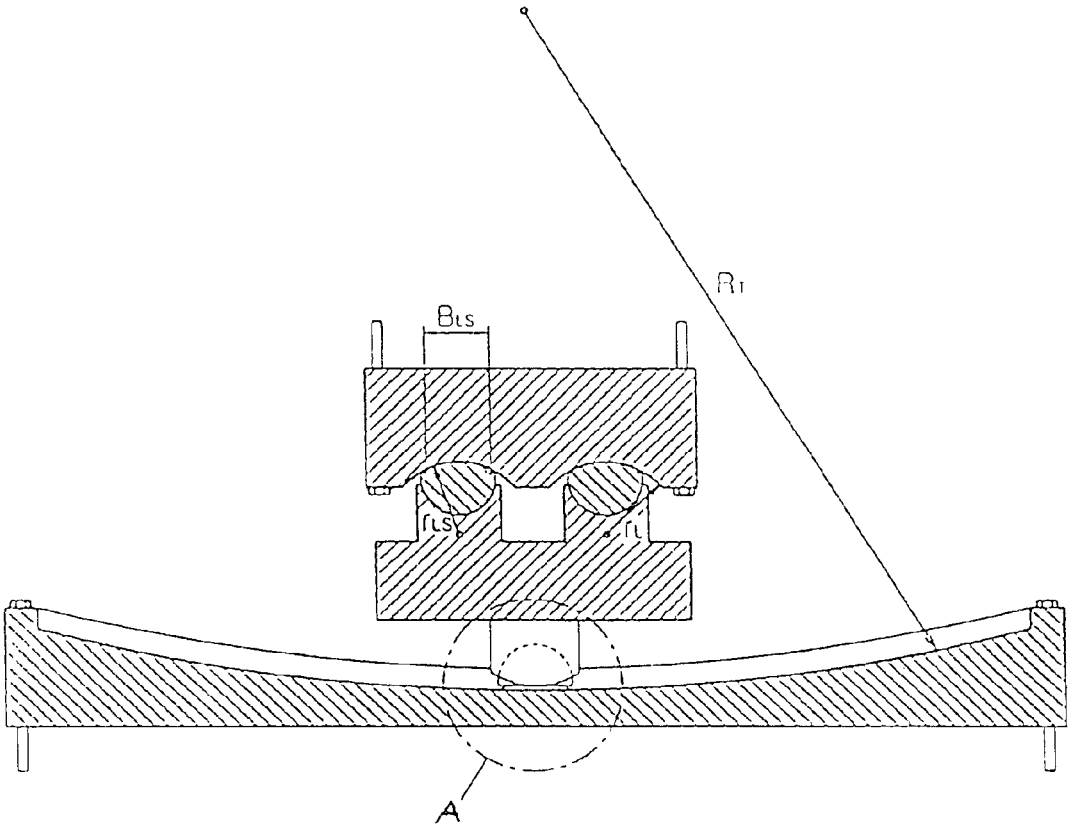
FIG. 23*c* is a sectional view of a used state of the sliding assembly according to FIG. 23*a;*

FIG. 23*a* is a perspective view of a hemispherical slider core 50 having a hemispheric lower part. FIG. 23*b* is a perspective view of a shape that the hemispherical slider core 50 is mounted on the slider support 45. FIG. 23*c* is a sectional view of a state that the sliding assembly is mounted on the bi-directional sliding pendulum seismic isolation system, and FIG. 23*d* is an enlarged view of an "A" portion of FIG. 23*c*.

In the hemispherical slider core 50 of this embodiment, the surface 51 in direct contact with the sliding channel 11 of the lower sliding plate 10 has the radius of curvature ($R_{TS}$) in the x-axis direction, which is the same as or smaller than the radius of curvature ($R_T$) of the longitudinal direction of the sliding channel 11 of the lower sliding plate 10. The surface 51 in direct contact withe the sliding channel 21 of the upper sliding plate 20 has the radius of curvature ($R_{LS}$) in the x-axis direction, which is the same as or smaller than the radius of curvature ($R_L$) of the longitudinal direction of the sliding channel 21 of the upper sliding plate 20 and the radius of curvature ($r_{LS}$) in the y-axis direction, which is the same as or smaller than the radius of curvature ($r_L$) of perpendicular direction of the sliding channel. In the slider core 50 of this embodiment, a surface 52 inserted into the slider support 45 is in the form of a sphere of a predetermined radius ($R_{MS}$) (see FIG. 23*d*).

As shown in FIG. 23*b*, the hemispherical slider core 50 is mounted on the slider support 45. Because the lower surface of the slider core is in the form of a hemisphere, the slider core 50 can rotate freely in all horizontal directions with respect to the slider support 45.

Figure 23D:
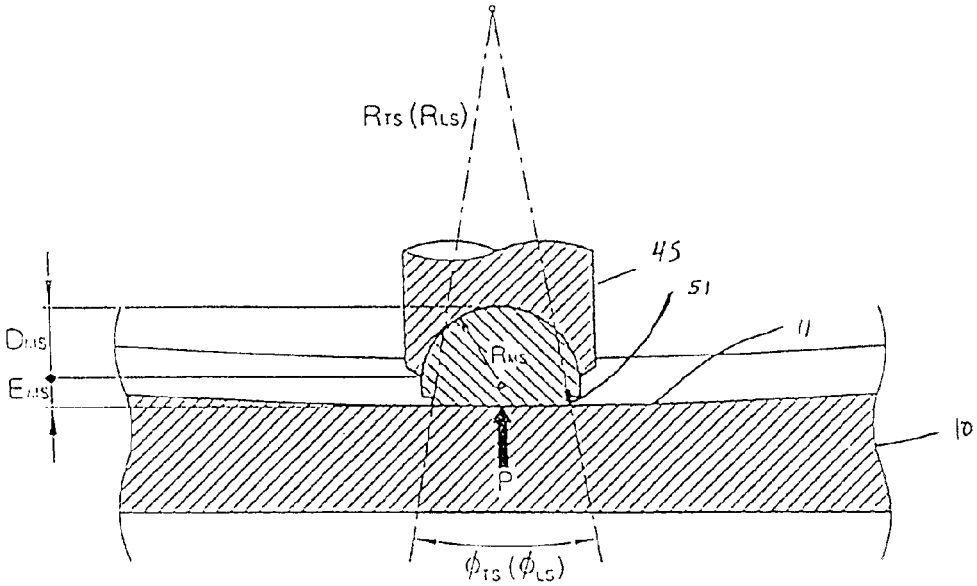
FIG. 23*d* is an enlarged sectional view of an "A" portion of FIG. 23*c;*

In FIG. 23*d*, $\Phi_{TS}$ means an inner angle of arc of the surface 51 of the slider core that is in contact with the channel 11 of the lower sliding plate 10. The inner angle of arc of the surface 51 of the slider core that is in contact with the channel 21 of the upper sliding plate 20 will be denoted as $\Phi_{LS}$. $D_{MS}$ means the depth that the slider core 50 is buried in the slider support 45 and $E_{MS}$ means a value that the depth ($D_{MS}$) is subtracted from a height of the whole slider core 50. $B_{LS}$ means a thickness of the upper surface of the slider core 50 of the perpendicular direction of the sliding channel 21 of the upper sliding plate 20.

Because the slider core 50 having the hemispheric lower surface can rotate in all directions with respect to the slider support 45, a contact area between the slider core 50 and the sliding channel is maintained uniform regardless the sliding assembly is located at any position of the sliding channel, and thereby the compressive force (P) is always transferred through the center of the slider. Therefore, the movement of the sliding assembly is performed in the more stable state.

Referring to FIGS. 24*a* through 24*d*, an embodiment of the sliding assembly including a slider support having a disc type supporting part of a convex shape and a slider core of a concave shape corresponding to the convex supporting part.

Figure 24A:
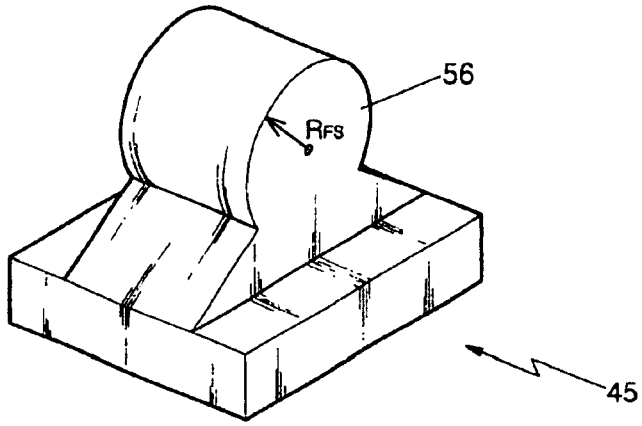
FIG. 24*a* is a perspective view of an end of a slider support of the sliding assembly according to another embodiment.
Figure 24B:
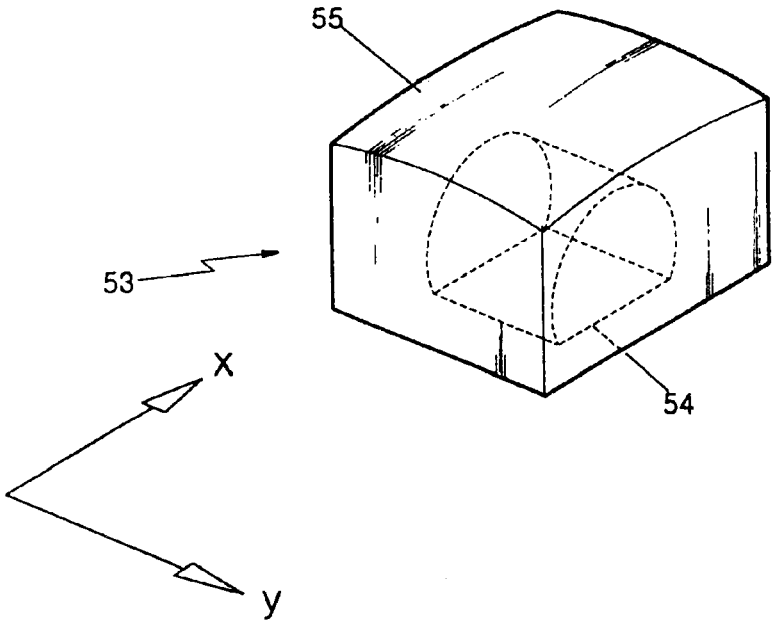
FIG. 24*b* is a schematic view of a form of the slider core coupled to the slider support.
Figure 24C:
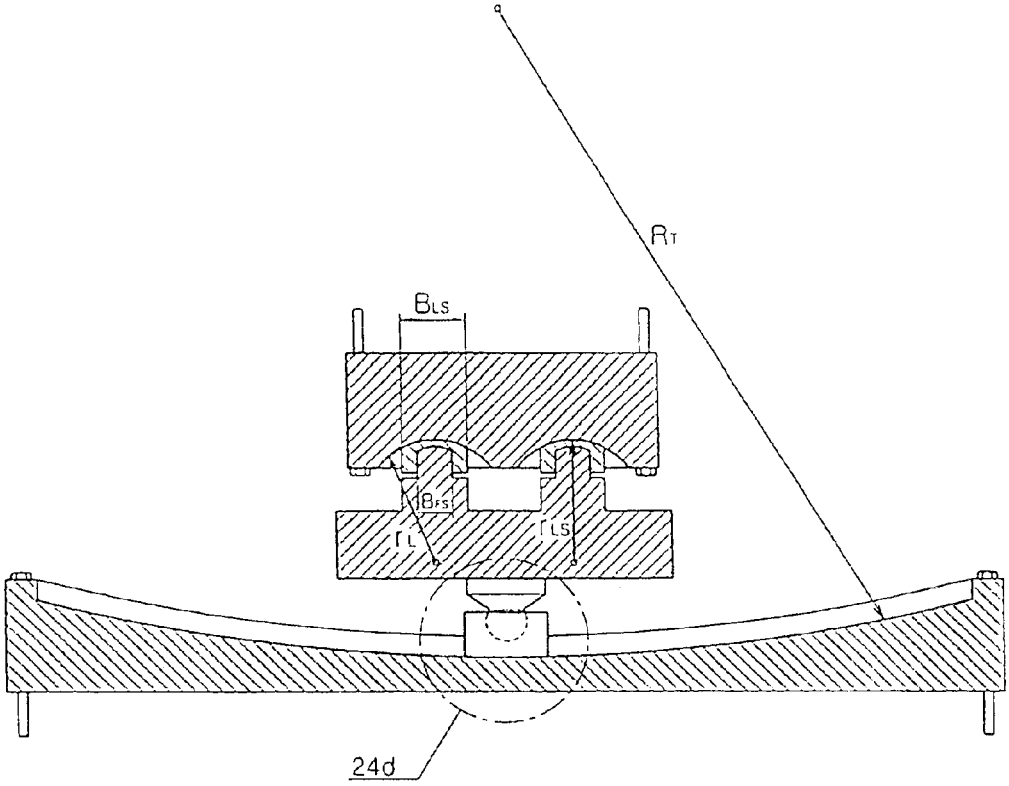
FIG. 24*c* is a sectional view of a used state of the sliding assembly of FIG. 24*a;*
Figure 24D:
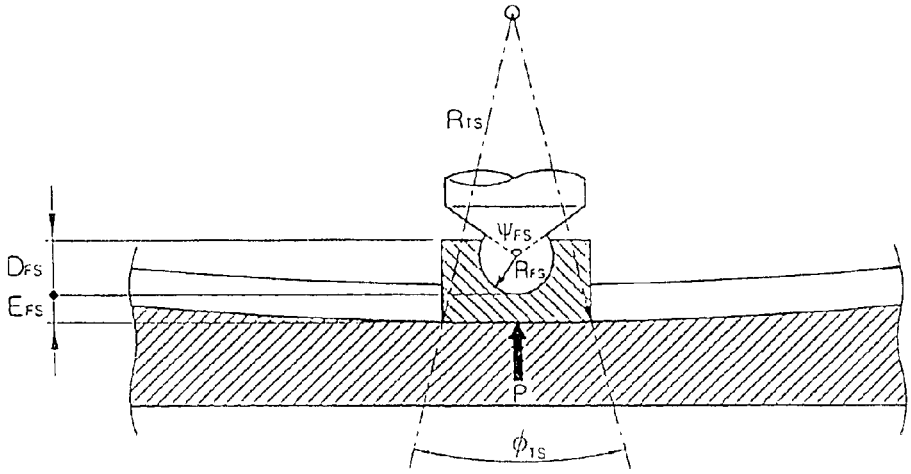
FIG. 24*d* is an enlarged sectional view of an A portion of FIG. 24*c;*

FIG. 24*a* is a perspective view of a shape of the disc type supporting part 56 formed at an end of the slider support 45. FIG. 24*b* is a perspective view of a shape of the concave slider core 53 put on the disc type supporting part 56 and directly in contact with the sliding channel. FIG. 24*c* is a sectional view showing a state that the sliding assembly is mounted on the bi-directional sliding pendulum seismic isolation system. FIG. 24*d* is an enlarged view of an "A" portion of FIG. 24*c*.

In this embodiment, the slider support 45 has the disc type supporting part 56 of a predetermined radius of curvature ($R_{FS}$) at an end thereof. As shown in FIG. 24*b*, the concave slider core 53 has a concave part 54 of a shape formed at a lower portion to correspond to the disc type supporting part 56. The disc type supporting part 56 is mounted on the slider support 45 to be inserted into the concave part 54.

The surface 55 of the concave slider core 53 directly in contact with the sliding channel 11 of the lower sliding plate 10 has a radius of curvature ($R_{TS}$) in the x-axis direction, which is the same as or smaller than the radius of curvature ($R_T$) of the longitudinal direction of the sliding channel 11 of the lower sliding plate 10. The surface 55 of the concave slider core 53 directly in contact with the sliding channel 21 of the upper sliding plate 20 has a radius of curvature ($R_{LS}$) in the x-axis direction, which is the same as or smaller than the radius of curvature ($R_L$) of the longitudinal direction of the sliding channel 21 of the upper sliding plate 20 and has a radius of curvature ($r_{LS}$) in the y-axis direction, which is the same as or smaller than the radius of curvature ($r_L$) of the perpendicular direction of the sliding channel 21 of the upper sliding plate 20.

In FIG. 24*d*, $\Phi_{TS}$ means the inner angle of arc of the upper surface 55 of the slider core in contact with the channel 11 of the lower sliding plate 10. The inner angle of arc of the upper surface 55 of the slider core in contact with the channel 21 of the upper sliding plate 20 is denoted as $\Phi_{LS}$. $D_{FS}$ means the depth that the disc type supporting part 56 of the slider support 45 is buried in the concave part 54 of the slider core 53, and $E_{FS}$ means a value that the depth ($D_{FS}$) is subtracted from a height of the slider core 53. In FIG. 24*c*, $B_{LS}$ means a thickness of the slider core 53 of the perpendicular direction of the sliding channel 21 of the upper sliding plate 20 and $B_{FS}$ means a thickness of the disc type supporting part 56 of the perpendicular direction of the sliding channel. $\Psi_{FS}$ means an angle of a neck portion of the disc type supporting part 56.

Also, in this embodiment, because the concave slider core 53 and the slider support 45 rotate freely with respect to each other, when the sliding assembly 30 slides on the sliding channels 11 and 21, the surface of the slider core 53 of the sliding assembly in contact with the sliding channels 11 and 21 can be maintained uniform, and thus the compressive force (P) is transferred through the center of the slider.

Therefore, the movement of the sliding assembly 30 is performed in the more stable state.

Referring to FIGS. 25*a* through 25*d*, an embodiment including a spherical slider support having a spherical supporting part and a concave slider core corresponding to the spherical supporting part.

Figure 25A:
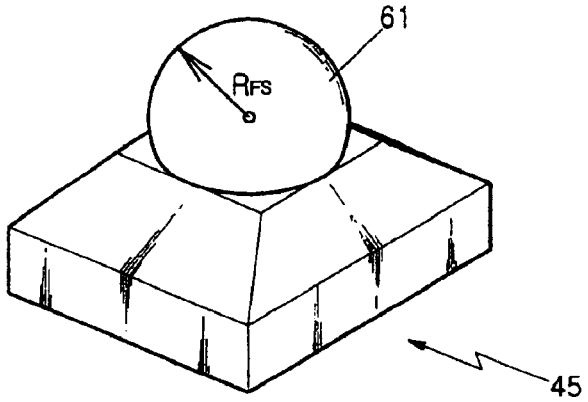
FIG. 25*a* is a perspective view of an end of the slider support of the sliding assembly according to a further embodiment.
Figure 25B:
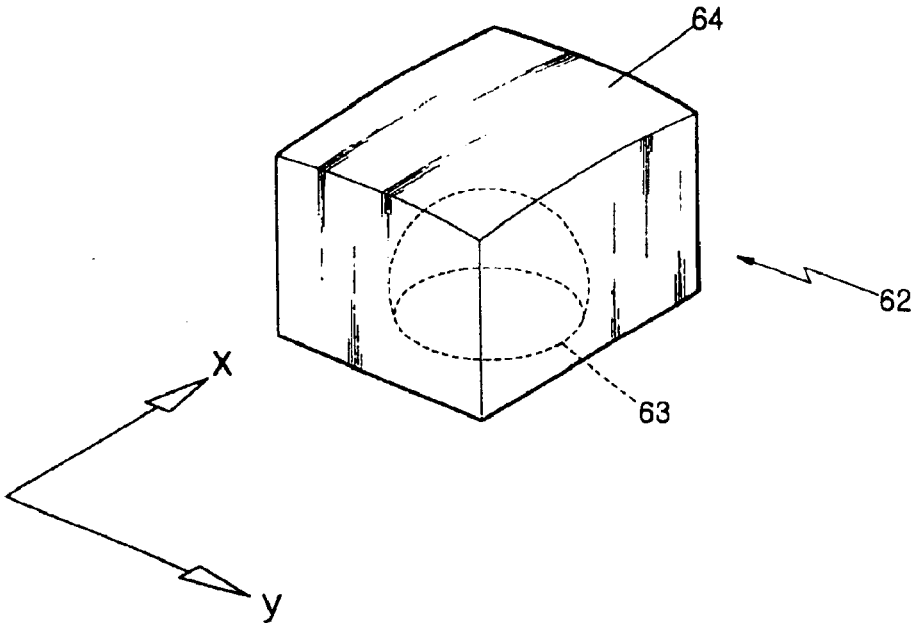
FIG. 25*b* is a schematic view of a form of the slider core coupled to the slider support.
Figure 25C:
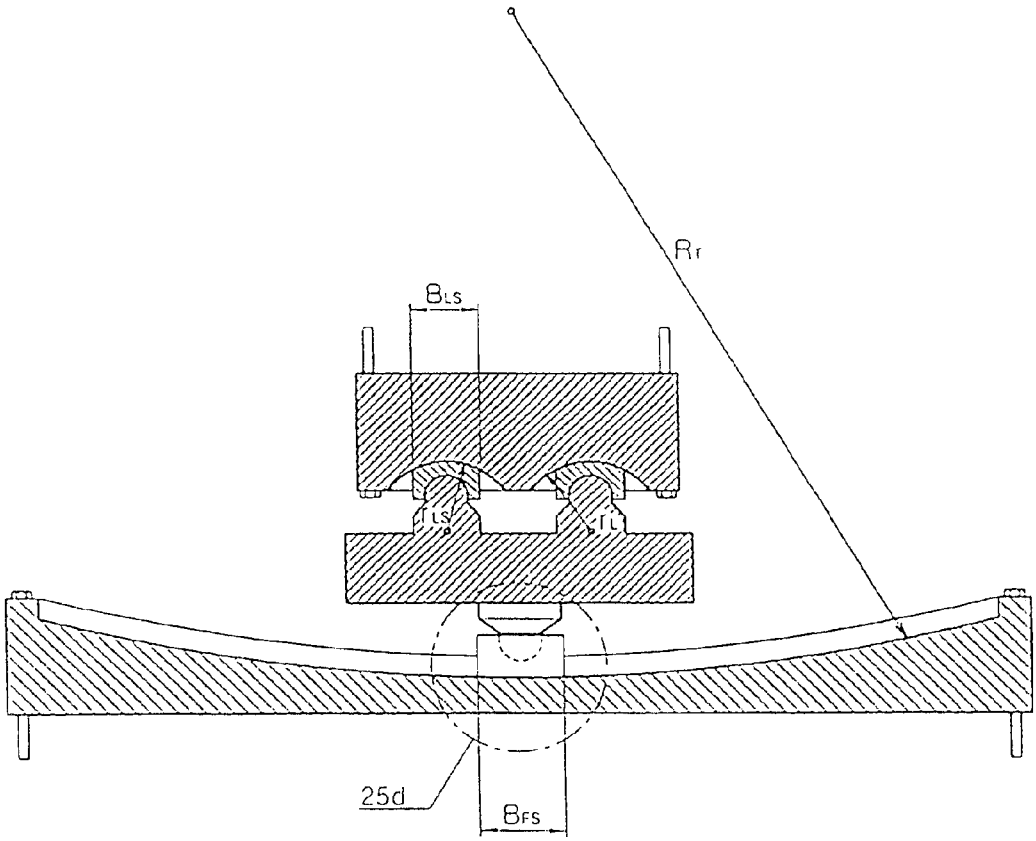
FIG. 25*c* is a sectional view of a used state of the sliding assembly of FIG. 25*a*.
Figure 25D:
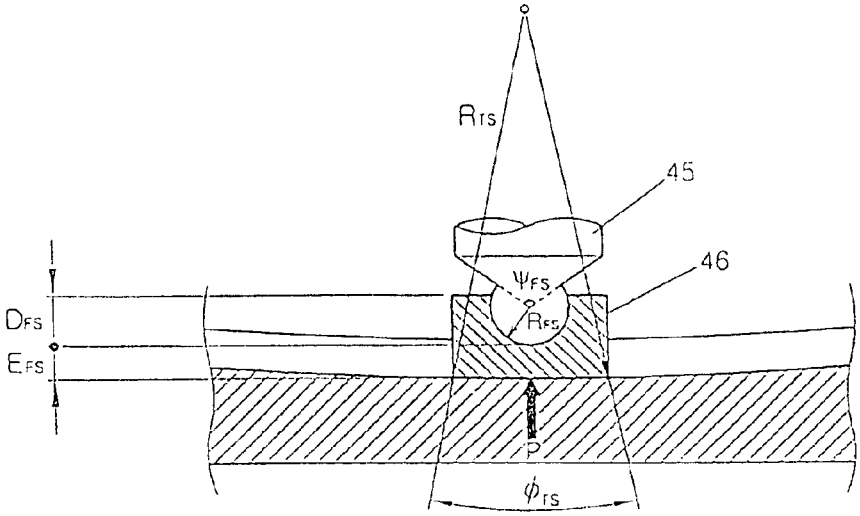
FIG. 25*d* is an enlarged sectional view of an "A" portion of FIG. 25*c*.

FIG. 25*a* is a perspective view of a shape of the spherical support 61 formed at an end of the slider support 45. FIG. 25*b* is a perspective view of a shape of the concave slider core 62 covered on the spherical supporting part 61 and directly in contact with the sliding channel. FIG. 25*c* is a sectional view showing a state that the sliding assembly is mounted on the bi-directional sliding pendulum seismic isolation system. FIG. 25*d* is an enlarged view of an "A" portion of FIG. 25*c*.

In this embodiment, the slider support 45 has the spherical supporting part 61 of a predetermined radius of curvature ($R_{FS}$) at an end thereof. As shown in FIG. 25*b*, the concave slider core 62 has a concave part 63 at a lower portion to correspond to the spherical supporting part 61. The spherical supporting part 61 is mounted on the slider support 45 to be inserted into the concave part 63.

The surface 64 of the concave slider core 62 directly in contact with the sliding channel 11 of the lower sliding plate 10 has a radius of curvature ($R_{TS}$) in the x-axis direction, which is the same as or smaller than the radius of curvature ($R_T$) of the longitudinal direction of the sliding channel 11 of the lower sliding plate 10. The surface 64 of the concave slider core 62 directly in contact with the sliding channel 21 of the upper sliding plate 20 has a radius of curvature ($R_{LS}$) in the x-axis direction, which is the same as or smaller than the radius of curvature ($R_L$) of the longitudinal direction of the sliding channel 21 of the lower sliding plate 20 and has a radius of curvature ($r_{LS}$) in the y-axis direction, which is the same as or smaller than the radius of curvature ($r_L$) of the perpendicular direction of the sliding channel.

In FIG. 25*d*, $\Phi_{TS}$ means an inner angle of arc of the surface 64 of the slider core in contact with the sliding channel 11 of the lower sliding plate 10. The inner angle of arc of the surface 64 of the slider core in contact with the sliding channel 21 of the upper sliding plate 20 is denoted as $\Phi_{LS}$. $D_{FS}$ means a depth that the spherical supporting part 61 of the slider support 45 is buried in the concave part 63 of the slider core 62, and $E_{FS}$ means a value that the depth ($D_{FS}$) is subtracted from a height of the slider core 62. In FIG. 25*c*, $B_{LS}$ means a thickness of the slider core 62 of the perpendicular direction of the sliding channel 21 of the upper sliding plate 20, and $B_{FS}$ means a thickness of the slider core 62 in the perpendicular direction of the sliding channel 21 of the upper sliding plate 20. $\Psi_{FS}$ means an angle of a neck portion of the spherical supporting part 61.

In case of the slider support 45 having the spherical supporting part 61, because the slider support 45 has the spherical end, the concave slider core 62 can rotate freely in all horizontal directions with respect to the spherical supporting part 61. Thus, even though the sliding assembly is located at any position, the contact area between the slider core 62 and the sliding channel is maintained uniform, and thereby the compressive force is always transferred to the center of the slider. Therefore, the movement of the sliding assembly is performed in the more stable state.

As described above, because the upper sliding plate of the bi-directional sliding pendulum seismic isolation system of the present invention is attached the girder or a slab of the bridge deck in the longitudinal direction of bridge and the lower sliding plate is mounted on the pier or the abutment in the direction perpendicular to the longitudinal axis of bridge or in an inclined direction, the seismic isolation system is not restricted in the installation space.

Moreover, because the seismic isolation period is freely selected in the longitudinal direction of bridge and in the direction perpendicular to the longitudinal axis of bridge or in the direction inclined with respect to the longitudinal axis of bridge, the isolation system most suitable for dynamic characteristics of the bridge can be designed. Furthermore, also after the earthquake, the orientation of the bridge can be always maintained in an initial state.

Especially, in the bi-directional sliding pendulum seismic isolation system of the present invention, because the lower sliding channel is installed into the first direction and the upper sliding channel is installed into the second direction, the upper sliding plate and the lower sliding plate can perform a relative motion in any directions to each other by the combination of the first direction and the second direction, and thus an effective seismic isolation action is obtained with respect to all horizontal directions.

The bi-directional sliding pendulum seismic isolation system of the present invention can have the seismic isolation effects not only of the horizontal direction but also of the perpendicular direction.

Moreover, if the uni-directional sliding pendulum seismic isolation system is used, only the seismic isolation effects of the uni-directional direction is obtained, but, if the unidirectional sliding pendulum seismic isolation system is installed in the multi-level, the seismic isolation effects of all horizontal directions are obtained, like the bi-directional sliding pendulum seismic isolation system.

Furthermore, in the sliding assembly of the present invention, because the slider core directly in contact with the sliding channel of the sliding pendulum seismic isolation system can rotate with respect to the slider support, the surface of the slider core being in contact with the sliding channel is maintained uniform even though the sliding assembly is located at any positions. The compressive force transferred through the upper sliding plate is always transferred through the center of the slider.

Thus, in the directional sliding pendulum seismic isolation system, the sliding assembly can move in the more stable state.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. Bi-directional sliding pendulum seismic isolation systems for reducing seismic force acting on a structure by sliding pendulum movements, each system comprising:

a lower sliding plate forming a sliding path in a first direction and having sliding channels having a radius of curvature;

an upper sliding plate forming a sliding path in a second direction and having sliding channels having a radius of curvature;

a sliding assembly for reducing the seismic force of the structure by performing a pendulum motion by sliding along the lower and upper sliding plates and including, a main body, lower sliders provided at a lower portion of the main body and sliding along lower sliding channels of the lower sliding plate and upper sliders provided at an upper portion of the main body, the upper sliders sliding along upper sliding channels of the upper sliding plate, each lower and upper sliders including, a slider support, a slider core mounted at an end of the slider support to freely rotate with respect to the slider support and being in frictional contact with said the sliding channels in such a manner that the area contacted with the sliding channels is maintained even though the sliding assembly is located in a random position of the sliding channel and the slider core having an upper surface of a shape corresponding to the radius of curvature of the sliding channels and a lower surface of a rounded shape having a predetermined radius of curvature, and rotates with respect to the slider support when the lower surface is mounted in the slider support.

2. A sliding assembly in a bi-directional sliding pendulum seismic isolation system, said sliding assembly comprising:

a main body;

lower sliders provided at a lower portion of said main body, the lower sliders sliding along lower sliding channels of a lower sliding plate of the bi-directional sliding pendulum seismic isolation system;

upper sliders provided at an upper portion of the main body, the upper sliders sliding along upper sliding channels of an upper sliding plate of the bi-directional sliding pendulum seismic isolation system;

the lower and upper sliders include a slider support, and a slider core mounted at an end of the slider support to freely rotate with respect to the slider support, the slider core being in frictional contact with the sliding channels in such a manner that the area contacted with the sliding channels is maintained even though the sliding assembly is located in a random position of the sliding channels; and the slider core has an upper surface of a shape corresponding to the radius of curvature of the sliding channels and a lower surface of a round shape having a predetermined radius of curvature, and rotates with respect to the slider support when the lower surface is mounted in the slider support.

* * * * *